US008161864B1

(12) United States Patent
Vuksanovich

(10) Patent No.: US 8,161,864 B1
(45) Date of Patent: Apr. 24, 2012

(54) FIREARM GAS PISTON OPERATING SYSTEM

(75) Inventor: Brian Vuksanovich, Poland, OH (US)

(73) Assignee: Sturm, Ruger & Company, Inc., Southport, CT (US)

( * ) Notice: Subject to any disclaimer, the term of this patent is extended or adjusted under 35 U.S.C. 154(b) by 256 days.

(21) Appl. No.: 12/409,839

(22) Filed: Mar. 24, 2009

(51) Int. Cl.
*F41A 5/00* (2006.01)

(52) U.S. Cl. ..... 89/191.01; 89/193

(58) Field of Classification Search ..... 89/156, 89/159, 179, 191.01–193
See application file for complete search history.

(56) References Cited

U.S. PATENT DOCUMENTS

| | | | | |
|---|---|---|---|---|
| 2,783,685 | A | 3/1957 | Green | |
| 2,951,424 | A | 9/1960 | Stoner | |
| 3,020,807 | A | 2/1962 | Hailston et al. | |
| 3,027,672 | A | 4/1962 | Sullivan | |
| 3,127,812 | A | 4/1964 | Into et al. | |
| 3,246,567 | A | 4/1966 | Miller | |
| 3,318,192 | A | 5/1967 | Miller et al. | |
| 3,618,457 | A | 11/1971 | Miller | |
| 3,675,534 | A * | 7/1972 | Beretta | 89/185 |
| 4,095,654 | A | 6/1978 | Ross | |
| 4,125,054 | A | 11/1978 | Jennie | |
| 4,201,113 | A | 5/1980 | Seecamp | |
| 4,244,273 | A * | 1/1981 | Langendorfer et al. | 89/193 |
| 4,373,423 | A | 2/1983 | Moore | |
| 4,414,880 | A | 11/1983 | Throner | |
| 4,433,610 | A | 2/1984 | Tatro | |
| 4,475,438 | A | 10/1984 | Sullivan | |
| 4,658,702 | A | 4/1987 | Tatro | |
| 4,702,146 | A | 10/1987 | Ikeda et al. | |
| 4,756,228 | A | 7/1988 | Rath | |
| 4,765,224 | A | 8/1988 | Morris | |
| 4,867,039 | A | 9/1989 | Dobbins | |
| 4,977,815 | A | 12/1990 | Stephens | |
| 5,123,194 | A | 6/1992 | Mason | |

(Continued)

FOREIGN PATENT DOCUMENTS

WO WO2006/137874 A2 12/2006

OTHER PUBLICATIONS

Author Unknown, Modern Firearms-Steyr Stg. 77AUG assault rifle, http://world.guns.ru/assault/as20-e, Mar. 20, 2008, 8 pages.

(Continued)

*Primary Examiner* — Michael Carone
*Assistant Examiner* — Joshua Freeman
(74) *Attorney, Agent, or Firm* — Duane Morris LLP; Frank J. Spanitz

(57) ABSTRACT

A gas piston operating system for an autoloading firearm. The gas piston system may include a barrel having a longitudinally-extending bullet pathway, a gas block defining a piston bore, a passageway fluidly connecting the bore with the bullet pathway for diverting combustion gas from the pathway to the bore upon discharging the firearm, and a piston slidably disposed in the bore for reciprocating movement. In one embodiment, the piston includes a head having an axially-extending protrusion projecting towards the passageway. The protrusion is configured for slidable insertion into the passageway. The piston is movable from a first actuation position in which the protrusion is inserted into the passageway to a second actuation position in which the protrusion is at least partially withdrawn from the passageway. The protrusion acts to pretension a mechanical linkage between the piston and a reciprocating bolt assembly.

18 Claims, 17 Drawing Sheets

U.S. PATENT DOCUMENTS

| | | | | |
|---|---|---|---|---|
| 5,247,758 | A | 9/1993 | Mason | |
| 5,279,200 | A | 1/1994 | Rose | |
| 5,305,539 | A | 4/1994 | Von Kuster | |
| 5,351,598 | A | 10/1994 | Schuetz | |
| 5,388,500 | A | 2/1995 | Petrovich | |
| 5,404,790 | A | 4/1995 | Averbukh | |
| 5,429,034 | A | 7/1995 | Badali et al. | |
| 5,520,019 | A | 5/1996 | Schuetz | |
| 5,682,007 | A | 10/1997 | Dobbins | |
| 5,698,810 | A | 12/1997 | Rose | |
| 5,726,377 | A | 3/1998 | Harris et al. | |
| 5,760,328 | A | 6/1998 | Robbins | |
| 5,824,943 | A | 10/1998 | Guhring et al. | |
| 5,834,678 | A | 11/1998 | Kalb | |
| 5,886,281 | A | 3/1999 | Kirstein | |
| 5,909,002 | A | 6/1999 | Atchisson | |
| 5,959,234 | A | 9/1999 | Scaramucci et al. | |
| 6,508,160 | B2 | 1/2003 | Beretta | |
| 6,526,686 | B1 | 3/2003 | Poff, Jr. et al. | |
| 6,606,934 | B1 | 8/2003 | Rock et al. | |
| 6,681,677 | B2 | 1/2004 | Herring | |
| 6,722,255 | B2 | 4/2004 | Herring | |
| 6,848,351 | B1 | 2/2005 | Davies | |
| 6,931,978 | B1 | 8/2005 | Dionne | |
| 7,059,235 | B2 | 6/2006 | Hanslick et al. | |
| 7,213,498 | B1 | 5/2007 | Davies | |
| 7,461,581 | B2 | 12/2008 | Leitner-Wise | |
| 7,832,326 | B1 * | 11/2010 | Barrett | 89/191.01 |
| 7,891,284 | B1 * | 2/2011 | Barrett | 89/193 |
| 2002/0139241 | A1 | 10/2002 | Butler | |
| 2005/0011345 | A1 | 1/2005 | Herring | |
| 2005/0081707 | A1 | 4/2005 | Herring | |
| 2005/0115398 | A1 | 6/2005 | Olson | |
| 2005/0241470 | A1 | 11/2005 | Hochstrate et al. | |
| 2006/0065112 | A1 * | 3/2006 | Kuczynko et al. | 89/193 |
| 2006/0236582 | A1 | 10/2006 | Lewis et al. | |
| 2006/0254414 | A1 | 11/2006 | Kuczynko et al. | |
| 2006/0266209 | A1 | 11/2006 | Grabowski | |
| 2007/0033851 | A1 | 2/2007 | Hochstrate et al. | |
| 2007/0199435 | A1 * | 8/2007 | Hochstrate et al. | 89/191.02 |
| 2009/0223357 | A1 * | 9/2009 | Herring | 89/192 |

OTHER PUBLICATIONS

Author Unknown, Steyr AUG, http://en.wikipedia.org/wiki/Steyr_AUG, Mar. 19, 2008, 6 pages.

Author Unknown, The Monolith: Quick-Change Barrel System for the M-16, http://www.military.com/soldiertech/0,14622,soldiertech_RailPlatform, Mar. 20, 2008, 8 pages.

Author Unknown, The HK416 http://www.hkpro.com/hk416, Nov. 28, 2007, 13 pages.

Author Unknown, Armalite AR-18: The Windowmaker, http://www.weaponryonline.com/Reviews-req-showcontent-id-15, Apr. 3, 2008, 4 pages.

Author Unknown, Armalite AR-18 assault rifle, http://world.guns.ru/assault/as36-e, Apr. 3, 2008, 6 pages.

Author Unknown, AR-10, http://en.wikipedia.org/wiki/AR-10, Mar. 19, 2008, 6 pages.

Author Unknown, Heckler & Koch HK416, http://en.wikipedia.org/wiki/Heckler_%26_Koch_HK416, Mar. 19, 2008, 4 pages.

Author Unknown, AR-15, http://en.wikipedia.org/wiki/AR-15, Mar. 19, 2008, 7 pages.

Author Unknown, M16 Rifle, http://en.wikipedia.org/wiki/M16_rifle, Mar. 19, 2008, 22 pages.

Author Unknown, Ultimax 100, http://en.wikipedia.org/wiki/Ultimax_100, Mar. 13, 2008, 4 pages.

Author Unknown, STK/CIS Ultimax 100 light machine gun (Singapore), http://world.guns.ru/machine/mg20-e, Mar. 13, 2008, 3 pages.

Author Unknown, M4 Carbine, http://en.wikipedia.org/wiki/M4_Carbine, Mar. 19, 2008, 8 pages.

Author Unknown, Steyr Stg. 77 AUG assault rifle (Austria), http://world.guns.ru/assault/as20-e, Mar. 20, 2008, 8 pages.

Singapore Technologies Kinetics, Ultimax 100—The Lightest 5.56 mm Calibre Machine Gun in the World, 2 pages.

David Crane, Ultimax 100 MK4: Best Choice for USMC infantry Automatic Rifle, http://www.defensereview.com/modules.php?name=News&file=article&sid=853, Mar. 13, 2008, 4 pages.

Nicholls Firearms & Ammo, Heckler & Koch HK416 Enhanced Carbine, 1 page.

Author Unknown, STK/CIS Ultimax 100 Light Machine Gun (Singapore), http://modernfirearms.net/machine/mg20-e, Mar. 19, 2008, 4 pages.

Corresponding PCT/US2010/027782 Search Report and Written Opinion May 17, 2010, 9 pages.

Corresponding PCT/US2010/034506 Search Report and Written Opinion Jul. 15, 2010, 10 pages.

"Comparing Carbines", Flash Design by Bryan Smith/Staff, 3D Animation by Chris Broz/Staff from Animation comparing H&k 416 Carbine and M4 Carbine/The Firearm Blog at http://www.thefirearmblog.com/blog/2007/09/09/ animation-comparing-hik-416-carbine-a . . . Oct. 17, 2011, 5 pages.

* cited by examiner

FIREARM GAS PISTON OPERATING SYSTEM

BACKGROUND OF THE INVENTION

The present invention generally relates to firearms, and more particularly to gas piston operating systems for auto-loading semi-automatic and automatic firearms.

Gas operating systems are known for cycling the action in auto-loading semi-automatic and automatic rifles. These systems basically use a portion of the high energy combustion gases from discharging the firearm to cycle the action for extracting a spent cartridge case and chambering a new round. One type of known system is a gas piston system used in AK-47 and AR-18 type rifles. These piston systems, also called blowback systems, are generally described in U.S. Pat. Nos. 5,520,019; 4,475,438; and 3,618,457; all of which are incorporated herein by reference in their entireties. A portion of the expanding combustion gases produced by discharging the rifles are ported from the barrel into a cylindrical piston bore containing an axially-movable reciprocating gas piston. The gas acts on the face of the piston driving it abruptly and rapidly rearward. An operating or transfer rod mechanically links the piston to a reciprocating bolt carrier slidably supported in the receiver disposed rearward at the breech end of the barrel. The bolt carrier, which carries a reciprocating and typically rotatable breech bolt, is thrust rearward by a brief but forceful impact by the transfer rod to open the breech, and extract and eject the spent case. The bolt carrier is then returned forward in some designs by a return/recoil spring to automatically load a new cartridge into the chamber from the magazine and reclose the breech in preparation for firing the next round. Such recoil spring systems are generally described U.S. Pat. Nos. 2,951,424 and 4,475,438, which are incorporated herein by reference in their entireties.

The foregoing gas piston systems are sometimes prone to rattling and wear of components due to a loose fit and/or physical gaps that may exist between the piston, transfer rod, and bolt carrier prior to firing a round. When the firearm is discharged, the piston is rapidly accelerated rearward under the full pressure force of the combustion gases entering the piston bore (i.e. constant recoil mechanisms operating under a single pressure force). Accordingly, the piston is moved from complete stop to full speed in a fraction of a second in a single stage piston actuation process. This creates high instantaneous forces and stresses on the mechanical linkage and contact surfaces between the piston, transfer rod, and bolt carrier.

An improved gas piston operating system is desirable.

SUMMARY OF THE INVENTION

The present invention provides a gas piston operating system for a firearm that pre-tensions the mechanical linkage to reduce or eliminate loose fits and/or physical gaps and clearances between linkage components that may cause rattling, wear, or damage of the gas system linkage-related components described above. In addition, maintaining tight tolerances and clearances is desirable for user-replaceable firearm barrels as described herein where proper clearances between parts are necessary to make implementation of a quick change barrel system possible and expedient. In a preferred embodiment, the present invention provides staged piston actuation including an initial first partial actuation stage in which a reduced cross-section of the piston is exposed to the full pressure force of the gas followed by a second full piston actuation stage in which is the full piston cross-section is exposed to the full pressure force of the gas. The initial piston actuation stage functions to reduce the initial peak force generated by the combustion gas propellant, and puts all parts or linkages of the piston actuation system in contact, which in one embodiment includes an axially movable operating or transfer rod that operably links the piston to the bolt carrier. The second full piston actuation stage then completes movement of the entire action after all parts or linkages of the piston actuation system have been placed into contact with each other during the initial first partial piston actuation stage. The linkage pre-tensioning mechanism is further intended to reduce impact forces and stresses between the piston, transfer rod, and bolt carrier to minimize component failures and operating problems by eliminating physical gaps that may exist between these components prior to discharging the firearm.

In one embodiment, the initial first partial piston actuation stage preferably includes exposing only a portion of the entire piston face to the full pressure of the combustion gas for a period of time wherein an associated first pressure force is applied to the piston. A subsequent second full piston actuation stage includes exposing substantially the entire piston face to the full pressure of the gas wherein an associated second and full pressure force is applied to the piston. Preferably, the full pressure force applied to the piston face is larger than the initial pressure force and is sufficient to fully cycle the action including cycling a reciprocating bolt carrier between forward and rearward positions for ejecting spent casings from and loading new cartridges into the firearm. The initial partial pressure force, however, preferably is sufficient to pre-tension the mechanical gas piston system linkage and close physical gaps between linkage components prior to full actuation and displacement of the piston. In one embodiment, the full piston bore is not pressurized during the initial piston actuation stage as further described herein.

In operation, as further described herein, the 2-stage gas piston is intended to minimize the effect of the peak of the typical pressure curve associated with the combustion gas generated in the firearm barrel by igniting the cartridge propellant. In one embodiment, a smaller reduced diameter protrusion such as an axially extending stud may be formed on the face of the piston that produces a smaller force than the full diameter piston would make at peak combustion gas pressure. The stud is preferably inserted into a reduced diameter passageway leading from the barrel bore to the full piston bore that slidably receives the piston. As the piston (and the autoloading action) moves, the pressure from the combustion of the propellant begins to decrease after initial ignition of the propellant. As the piston stud moves out of the reduced diameter passageway, which in some embodiments be part of a user-adjustable pressure regulator, the entire piston bore becomes pressurized, but by now, the combustion gas pressure has also dropped. At this point, the full face of the piston (including the stud) is now exposed to the gas pressure. This larger piston diameter compensates for the lower gas pressure, resulting in a more even and higher force that is applied to the action over the entire stroke of the piston. Accordingly, the initial higher peak pressure has produced a lower piston actuating force and the subsequent lower pressure later in the stroke has produced a higher force. This staged piston actuation operating method advantageously reduces wear of and increases the life of components, improves reliability because of a longer power stroke with less peak force on the piston, and the lower peak force upsets the barrel less, allowing the bullet to escape the barrel before the forces from the gas system disturb the barrel alignment to the target.

In one embodiment, a gas piston system for an autoloading firearm according to the present invention includes: a barrel having a longitudinally-extending bullet pathway; a gas block defining a piston bore; a passageway fluidly connecting the bore with the bullet pathway for diverting combustion gas from the pathway to the bore upon discharging the firearm; and a piston slidably disposed in the bore for reciprocating movement. The piston includes a head having an axially-extending protrusion projecting towards the passageway, and the protrusion is sized and configured for slidable insertion into the passageway. The piston is movable from a first actuation position in which the protrusion is inserted into the passageway to a second actuation position in which the protrusion is at least partially withdrawn from the passageway. In one embodiment, the protrusion blocks flow of combustion gas from the passageway to the piston bore when the piston is in the first position, and allows flow of combustion gas to the piston bore when the piston is in the second position. In some embodiments, the protrusion may be shaped as a cylindrical stud disposed on a face of the piston and forming a part thereof.

In another embodiment, a gas piston system for an autoloading firearm includes: a receiver slidably supporting a reciprocating bolt carrier; a barrel coupled to the receiver and having a longitudinally-extending bullet pathway; a gas block defining a piston bore having a diameter; a passageway fluidly connecting the bore with the bullet pathway for diverting combustion gas from the pathway to the bore upon discharging the firearm, the passageway having a diameter smaller than the diameter of the piston bore; and a piston slidably disposed in the bore for reciprocating movement, the piston including a head with an axially-extending cylindrical protrusion projecting towards the passageway, the protrusion being configured for slidable insertion into the passageway, the piston being movable from a first actuation position in which the protrusion is inserted into the passageway to a second actuation position in which the protrusion is at least partially withdrawn from the passageway.

In another embodiment, an autoloading firearm with gas piston operating system includes: a receiver slidably supporting a bolt carrier for reciprocating motion; a barrel coupled to the receiver and having a longitudinally-extending bullet pathway; a gas block defining a piston bore; a passageway fluidly connecting the bore with the bullet pathway for diverting combustion gas having a pressure from the pathway to the bore produced by discharging the firearm; a piston slidably disposed in the bore for reciprocating movement, the piston including a head defining a front face with a reduced diameter cylindrical stud projecting towards the passageway, the stud being slidably inserted in the passageway and the head being positioned in the bore; and a piston spring located in the bore and biasing the piston towards the passageway. The piston is movable in the bore by the combustion gas from: (i) a forward axial position in which only an end face of the stud is initially exposed to the combustion gas pressure; to (ii) a rearward axial position in which the entire front face of the piston head including the end face of the stud are exposed to combustion gas pressure.

Methods for actuating a piston in an autoloading firearm having a gas operating system are also provided. In one embodiment, the method includes: providing a firearm having a barrel defining a chamber for holding a cartridge and a bullet pathway, a receiver attached to the barrel, a reciprocating bolt assembly slidably received in the receiver for reciprocating motion, a gas piston slidably disposed in a piston bore of a gas block attached to the barrel for cycling the bolt assembly between forward and rearward positions, and a mechanical linkage operably coupling the piston to the bolt assembly; producing combustion gas having a pressure in the bullet pathway by discharging the firearm; flowing a portion of the gas from the bullet pathway to the piston; exerting a first gas pressure force on the piston; displacing the piston by a first axial distance; pre-tensioning the mechanical linkage between the gas piston and bolt assembly; exerting a second gas pressure force on the piston larger than the first gas pressure force; and displacing the piston by a second axial distance sufficient to fully cycle the bolt between the forward and rearward positions.

In another embodiment, a method for actuating a piston in an autoloading firearm having a gas operating system for cycling a reciprocating bolt assembly between forward and rearward positions for loading the firearm includes: locating a piston having a head and a reduced diameter stud extending therefrom in a piston bore that slidably receives the piston, the piston being mechanically linked to the bolt assembly by a transfer rod; blocking with the stud a passageway fluidly connecting a bullet pathway defined by a firearm barrel to the piston bore; exposing a first surface area on the stud to combustion gas flowing through the passageway from discharging the firearm; displacing the piston by a first axial distance; exposing a second surface area on the piston larger than the first surface area of the stud to the combustion gas; and displacing the piston by a second axial distance larger than the first axial distance wherein the bolt assembly is driven rearward.

BRIEF DESCRIPTION OF THE DRAWINGS

The features of the preferred embodiments will be described with reference to the following drawings where like elements are labeled similarly, and in which:

FIG. 6 is a perspective exploded view of the quick-change barrel assembly of the rifle;

Figure 1:
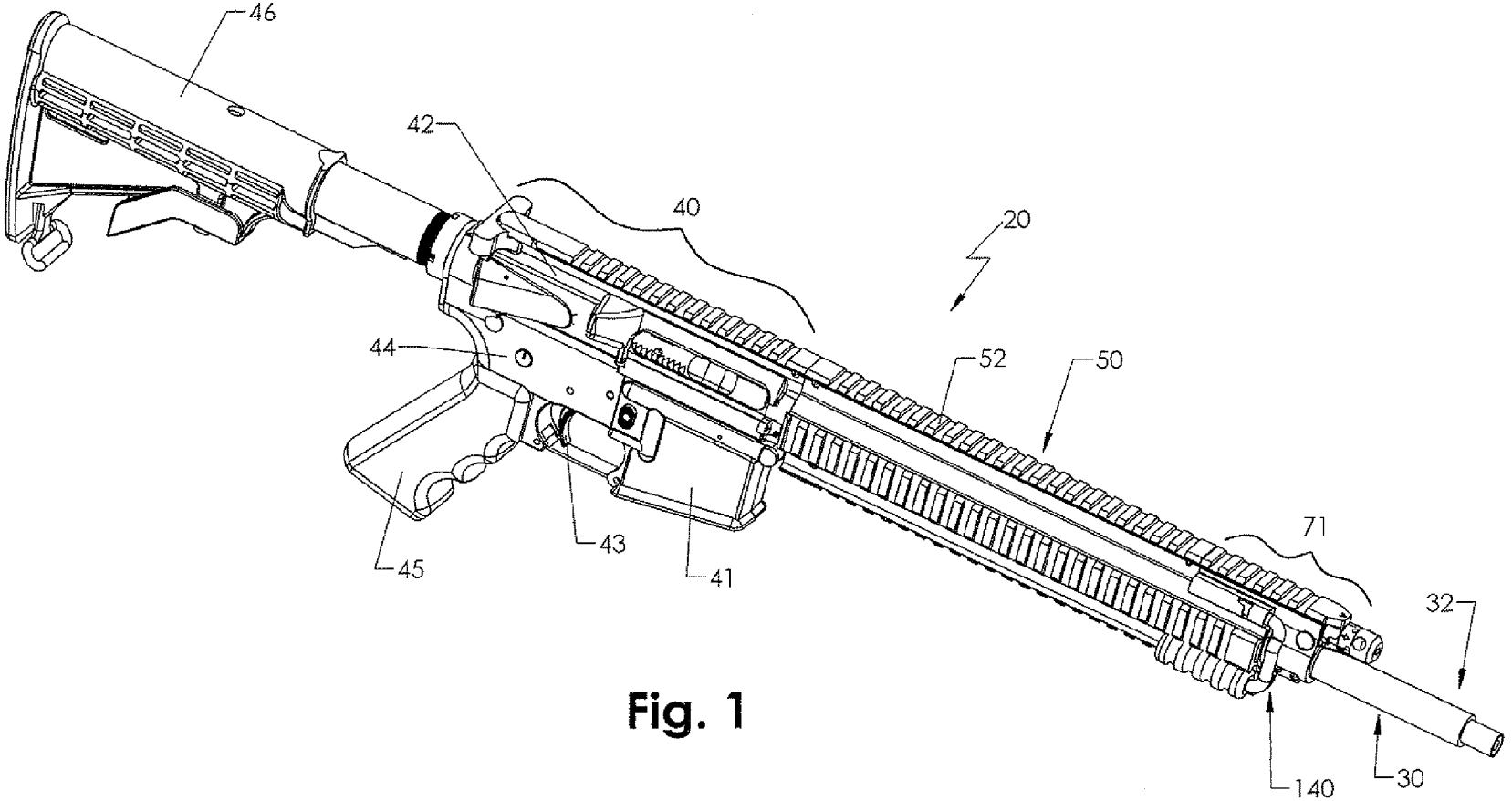
FIG. 1 is a perspective view of one embodiment of a rifle according to principles of the present invention.

All drawings are schematic and not to scale.

DESCRIPTION OF PREFERRED EMBODIMENTS

The features and benefits of the invention are illustrated and described herein by reference to preferred embodiments. Accordingly, the invention expressly should not be limited to such preferred embodiments illustrating some possible non-limiting combination of features that may exist alone or in other combinations of features; the scope of the invention being defined by the claims appended hereto. This description of preferred embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected" and "interconnected," refer to a relationship wherein structures are secured or attached to one another either directly or indirectly through intervening structures, as well as both movable or rigid attachments or relationships, unless expressly described otherwise. The term "action" is used herein with respect to firearms in its conventional sense being the combination of the receiver or frame, bolt assembly, and other related components associated with performing the functions of loading/unloading casings and cartridges and opening/closing the breech. The terms "forward" or "front" as used herein refers to a direction towards the muzzle end of a barrel, and the terms "rearward", "rear", or "back" refer to the opposite direction towards the stock or handgrip of the firearm.

A preferred embodiment of a barrel retaining system with quick-change capabilities will now be described for convenience with reference and without limitation to a rifle capable of semi-automatic or automatic firing. However, it will be appreciated that alternate embodiments formed according to principles of the present invention may be used with equal advantage for other types of firearms and the invention not limited in applicability to rifles alone as described herein.

Figure 2:
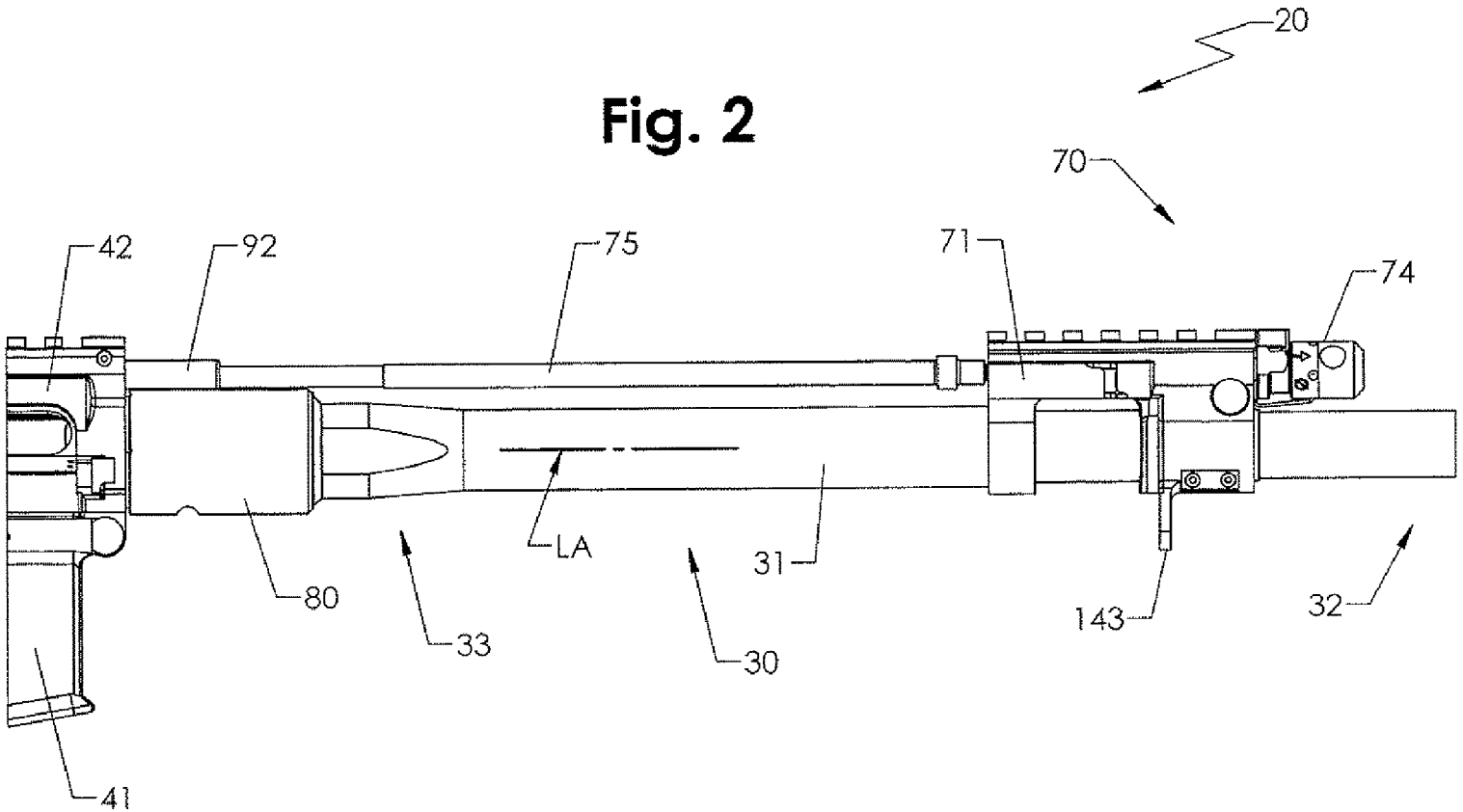
FIG. 2 is a partial side view of the rifle with handguard removed.

FIGS. 1 and 2 show a preferred embodiment of a rifle 20 according to principles of the present invention. In one embodiment, rifle 20 may preferably be a gas-operated auto-loading rifle with a rotating bolt-type action and magazine feed. FIG. 2 depicts the barrel portion of rifle 20 with the handguards removed to better show the arrangement of components hidden from view when the handguard is in place. As further described herein, rifle 20 includes a quick-change barrel retaining system intended to facilitate convenient and quick swapping of barrels in situations that include the combat arena.

Referring now to FIGS. 1 and 2, rifle 20 generally includes a receiver assembly 40 and a barrel assembly 30 mounted thereto via a locking member such as barrel nut 80. Receiver assembly 40 may house a conventional firing mechanism and related components such as those used in M-4 and M-16/AR-15 type rifles and their variants. Such firing mechanisms are generally described in U.S. Pat. Nos. 5,726,377 and 4,433,610, both of which are incorporated herein by reference in their entireties. As will be known to those skilled in the art, these firing mechanisms generally include a spring-biased hammer that is cocked and then released by a sear upon actuating the trigger mechanism. The hammer strikes a firing pin carried by the bolt, which in turn is thrust forward to contact and discharge a chambered cartridge. A portion of the expanding combustion gases traveling down the barrel is bled off and used to drive the bolt rearward against a forward biasing force of a recoil spring for automatically ejecting the spent cartridge casing and automatically loading a new cartridge into the chamber from the magazine upon the bolts forward return. Such recoil spring systems are generally described U.S. Pat. No. 2,951,424, which is incorporated herein by reference in its entirety. In a gas direct type system such as employed on M4 and M16-type rifles, the gas is directed rearwards through a tube to the breech area of the receiver and into a gas chamber associated with a reciprocating bolt carrier that holds the bolt. The gas acts directly on the bolt carrier. In a gas piston type system, such as used in AR-18 and AK-47 type rifles, the combustion gases are ported into a gas cylinder mounted on the barrel which contains a reciprocating piston. An operating or transfer rod mechanically links the piston to the bolt carrier in lieu of gas tube to drive the bolt carrier rearward after firing the rifle. The gas thus acts on the piston, which is remote from the breech area of the receiver and only mechanically linked to the bolt carrier. This latter type system generally keeps the breech area of the receiver cleaner than gas direct systems by reducing fouling and carbon accumulation on components from the combustion gases. Gas direct systems require more frequent cleaning and are generally more prone to malfunctions and misfires resulting from fouling. In addition, the piston system runs cooler than gas direct preventing components from getting hot and expanding (particularly during automatic firing mode) which can also result in malfunctions. In a preferred embodiment, the barrel retaining system according to principles of the present invention is preferably used in conjunction with a rifle employing a gas piston type system, which will be further described herein in pertinent part.

Referring now to FIGS. 1 and 2, receiver assembly 40 includes upper receiver 42 and lower receiver 44 which may be removably coupled together by conventional means. In some embodiments, upper receiver 42 may generally be a conventional M4 or M-16/AR-15 type upper receiver with modifications as described herein. Lower receiver 44 includes a buttstock 46, handgrip 45, trigger mechanism 43, and open magazine well 41 that removably receives a self-feeding magazine (not shown) for holding a plurality of cartridges. In some embodiments, the cartridges used may be 5.56 mm NATO rounds or other cartridge types suitable for use in semi-automatic and automatic rifles.

Bolt and Carrier: In one embodiment, a conventional rotating bolt is provided as commonly used in M4-type and M16/AR-15-type rifles. Referring to FIGS. 3, 4, and 8A-B, upper receiver 42 defines an internal longitudinally-extending cavity 47 configured to receive bolt assembly 60. Bolt assembly 60 is slidably disposed in cavity 47 for axial reciprocating recoil movement rearward and forward therein. Bolt assembly 60 includes a bolt carrier 61 and a rotatable bolt 62 such as generally described in U.S. Pat. Nos. 5,726,377, 4,3433,610, and 2,951,424, which are all incorporated herein by reference in their entireties. Bolt 62 is disposed in bolt carrier 61 in a manner that provides rotational and axial sliding movement of the bolt with respect to bolt carrier 61 in a conventional manner. When bolt assembly 60 is mounted in upper receiver 42, forward breech face 63 of bolt 62 protrudes outwards from inside bolt carrier 61 towards the front of rifle 20 for abutting a chambered cartridge when loaded in chamber 111 (see FIG. 13). A firing pin 200 (shown in FIGS. 3 and 4) is disposed in firing pin cavity 63 (see FIG. 4) for sliding axial movement therein to strike the chambered cartridge when struck on its rear by the hammer (not shown). Bolt 62 preferably includes a conventional transverse-mounted cam pin 67 that travels in a curved cam slot 68 defined by bolt carrier 61 to impart rotational movement to the bolt and limit its degree of rotation. Preferably, bolt 62 is made of steel. Bolt carrier 61 further includes a key 65 attached to or integral with the carrier. Key 65 includes a forward-facing thrusting surface 66 for engaging the transfer rod of the gas piston operating system described herein for cycling the action.

With continuing reference to FIGS. 3, 4, and 8A-B, bolt 62 further includes conventional laterally-protruding bolt lugs 64 located proximate to bolt breech face 63. Bolt lugs 64 extend outwards in a radial direction from bolt 62 and engage corresponding bolt locking lugs 105 associated with barrel assembly 30 to lock the breech prior to firing the rifle 20. In one preferred embodiment, bolt locking lugs 105 are formed in a preferably steel barrel extension 100 that is affixed to or integral with barrel 31. This provides a steel-to-steel locked breech when a chambered cartridge is detonated by the firing pin 200 after actuating the rifle's trigger mechanism. This steel-to-steel breech lockup withstands combustion forces and allows receiver assembly 40 to made of a lighter material, such as aluminum or aluminum alloy for weight reduction.

Barrel Assembly: Barrel assembly 30 will now be further described with initial reference to FIGS. 1-3, 5-7, and 13. Barrel assembly 30 includes a barrel 31 having a muzzle end 32 and breech end 33. Barrel 31 defines a longitudinal axis LA for rifle 20 and an inner barrel bore 34 that forms an axial path for a bullet. A portion of barrel bore 34 is enlarged near the breech end 33 to define a chamber 111 that holds a cartridge. Preferably, inner barrel bore 34 includes conventional rifling (not shown) in some embodiments for imparting spin to the bullet when rifle 20 is fired. A gas block 71 forming part of a gas piston operating system 70 is shown mounted towards the muzzle end 32 of barrel assembly 30. The gas piston operating system 70 is further described elsewhere herein.

Figure 3:
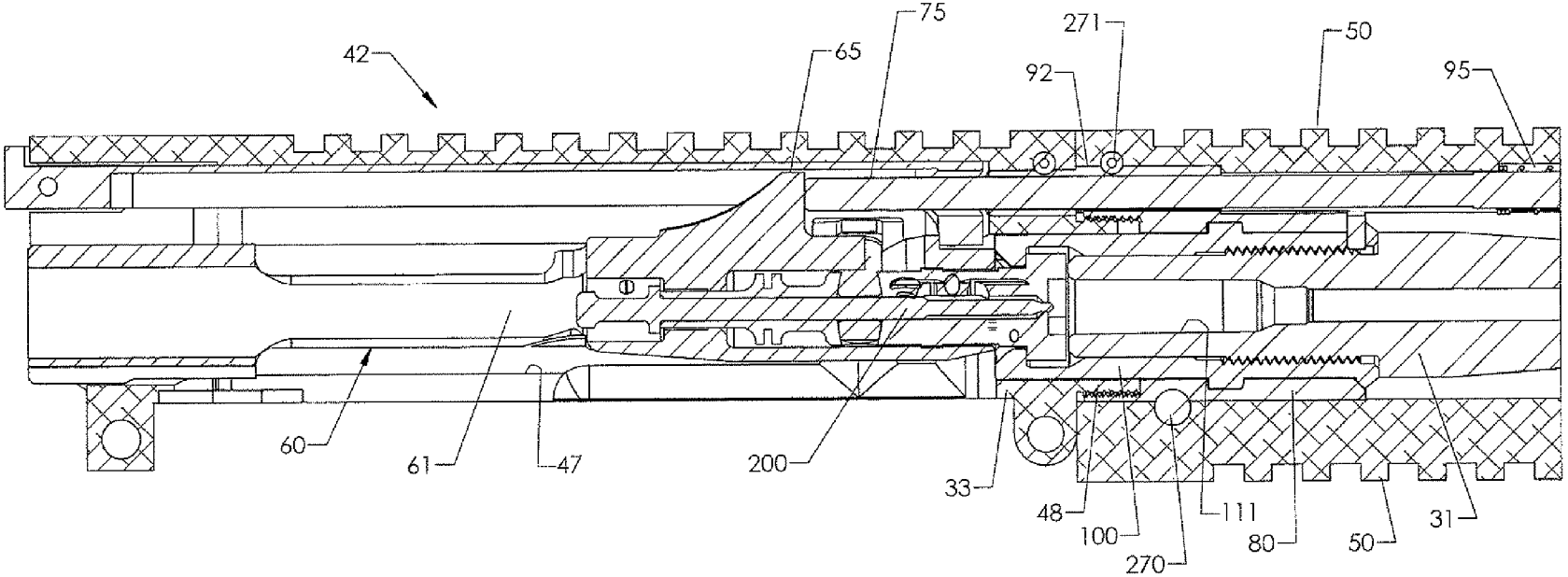
FIG. 3 is a partial cross sectional view of the upper receiver and breech end of the barrel of the rifle.
Figure 4:
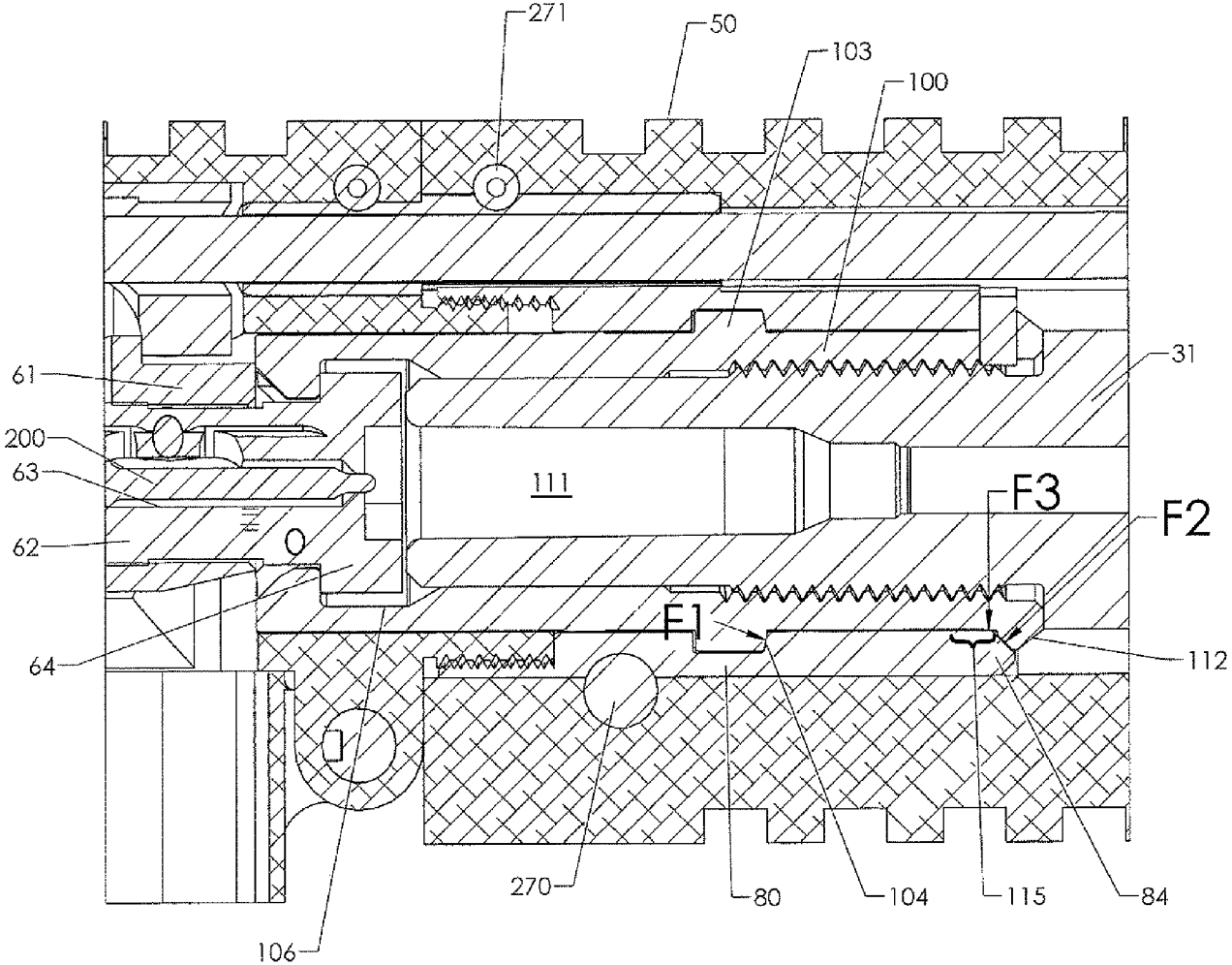
FIG. 4 is a detailed partial cross sectional view of the breech end of the barrel including the bolt, barrel extension, and barrel nut.

With additional reference now to FIGS. 14-20, barrel assembly 30 further includes a barrel extension 100 at breech end 33 of barrel 31. Barrel extension 100 defines an exterior surface 101 and an interior surface 102. A portion of exterior surface 101 defines an annular surface 114 for locating and receiving splines 81 of barrel nut 80. In one embodiment, annular surface 114 preferably extends axially in a longitudinal direction and may be formed between an annular flange 112 and barrel locking lugs 103 further described herein. Annular surface 114 preferably has an axial length sized to receive splines 81 as best shown in FIGS. 3 and 4.

In a preferred embodiment, barrel extension 100 may be a separate component removably attached to barrel 31 via a threaded connection. Accordingly, in one possible embodiment, barrel extension 100 may have internal threads 107 formed on interior surface 102 proximate to front end 108 which mate with complementary shaped external threads 35 formed proximate to or spaced inwards from breech end 33 of barrel 31 as shown. Other suitable conventional means of affixing barrel extension 100 to barrel 31 such as pins, screws, clamps, etc., or combinations of threading and such other means, may be used.

With continuing reference to FIGS. 14-21, opposite rear end 109 of barrel extension 100 includes conventional circumferentially-spaced bolt locking lugs 105 that project radially inwards from interior surface 102 to engage bolt lugs 64 of rotating bolt 62 (see FIGS. 4 and 8A-B) for closing and locking the breech in preparation for firing rifle 20 in a conventional manner. Rear end 109 of barrel extension 100 includes conventional angled feed ramps 110 to facilitate feeding cartridges into chamber 111 of barrel 31. A diametrically enlarged annular space 106 is provided in interior surface 102 of barrel extension 100 to receive bolt lugs 64 and allow bolt 62 to rotate in a usual conventional manner after bolt lugs 64 are inserted forward through bolt locking lugs 105.

Figure 13:
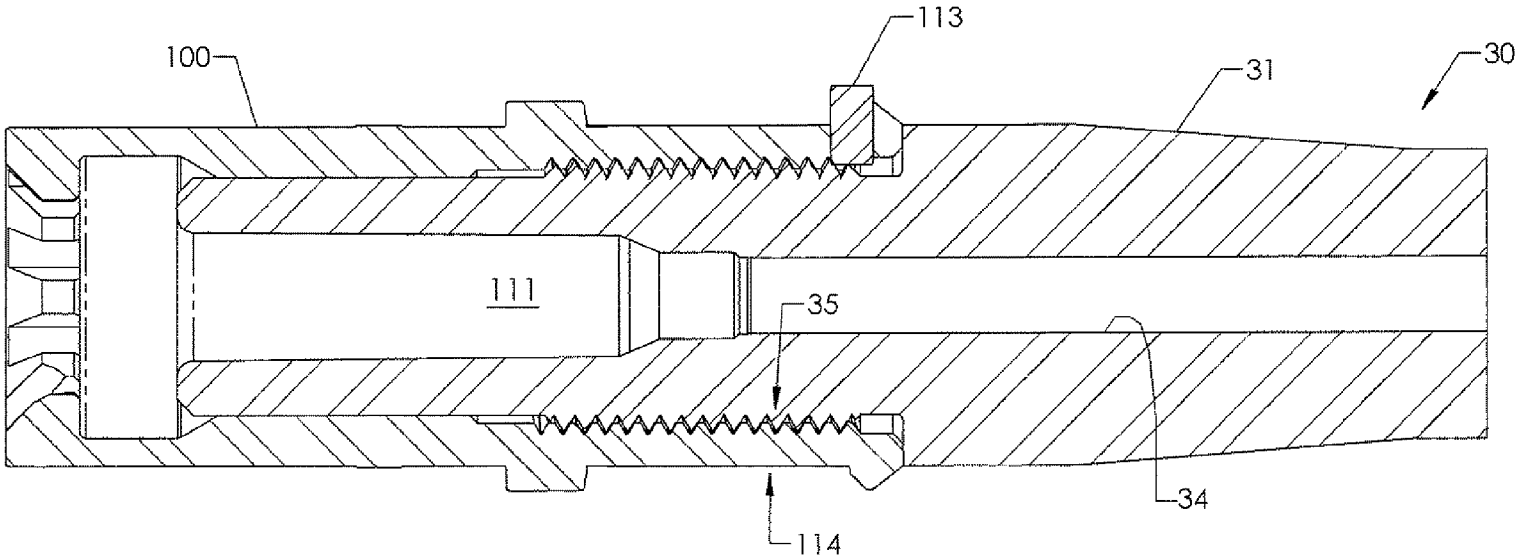
FIG. 13 is a cross-sectional side view of the breech end of the barrel with barrel extension attached thereto.
Figure 14:
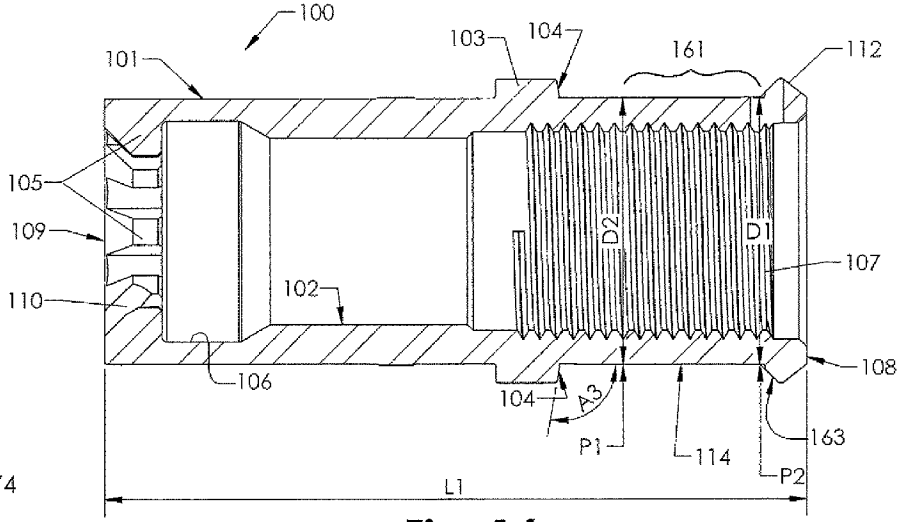
FIG. 14 is a cross-sectional top view of the barrel extension.
Figure 15:
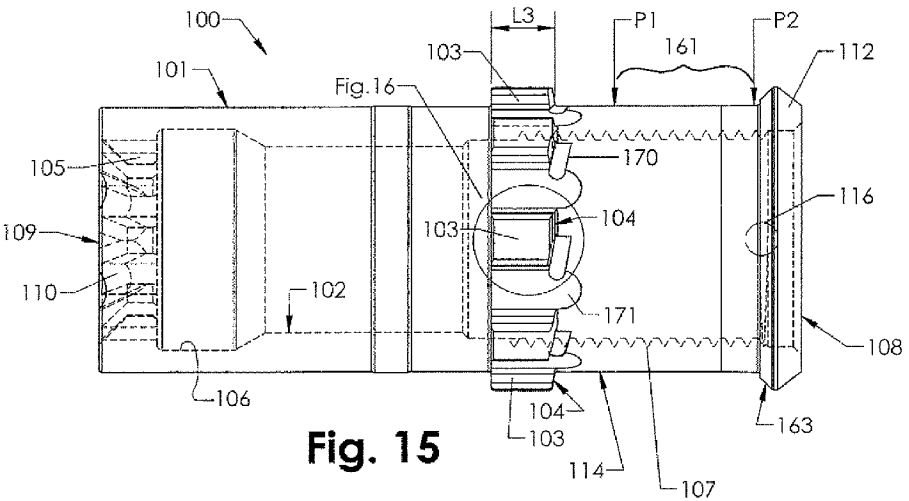
FIG. 15 is top view.

Unlike known barrel extensions, barrel extension 100 preferably includes barrel locking lugs 103 as shown in FIGS. 13-15 for detachably locking barrel assembly 30 to barrel nut 80 via corresponding splines 81 in the barrel nut. The barrel locking lugs 103 define a first locking mechanism for securing barrel assembly 30 to rifle 20. Barrel extension 100 is rotatable between a locked position in which the barrel locking lugs 103 are engaged with splines 81 to lock barrel assembly 30 to rifle 20, and an unlocked position in which barrel locking lugs 103 are not engaged with splines 81 to unlock the barrel assembly 30 from rifle 20. In a preferred embodiment, a plurality of opposing external barrel locking lugs 103 are provided and disposed on barrel extension 100. In other embodiments contemplated, barrel locking lugs may be disposed on barrel 31 (not shown) in alternative designs where no barrel extension is used. However, barrel extensions are favored in a preferred embodiment because the extensions may be detached from the used barrel and re-used on a new barrel. Because bolt locking lugs 105 and barrel locking lugs 103 are machined on barrel extension 100 that may be reused, fabrication of barrel 31 is less expensive. Each barrel assembly can be gauged individually for proper headspace before being installed into the rifle, and when a quick-change barrel system is used according to the present invention, each barrel will maintain headspacing regardless of the rifle it is installed in.

Figure 18:
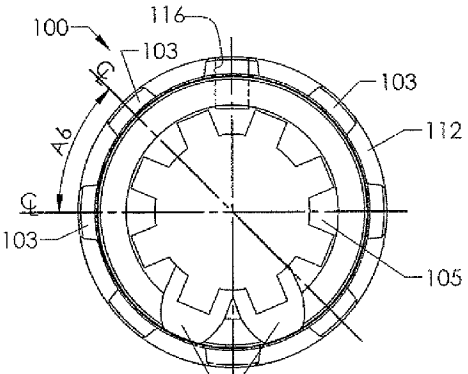
FIG. 18 is an end view of the barrel extension looking towards the breech end of the barrel extension.
Figure 22:
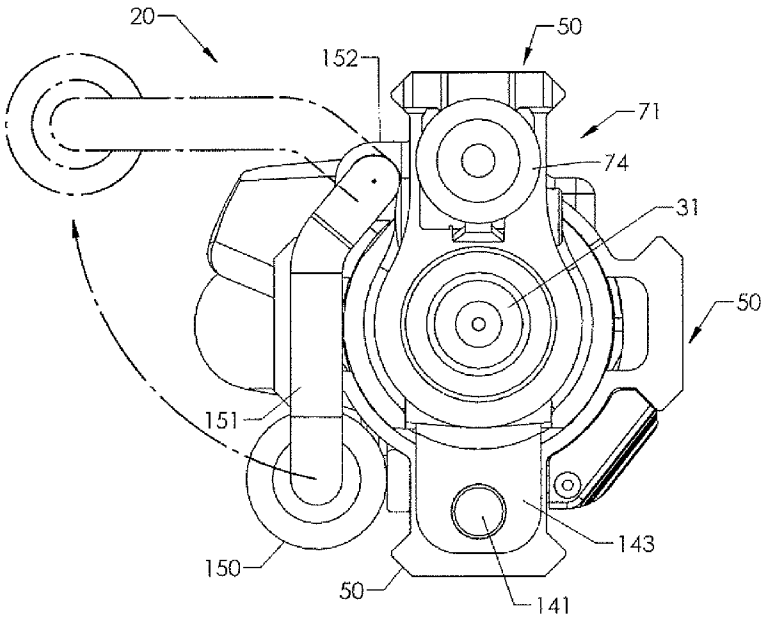
FIG. 22 is a front view of the muzzle end of the rifle looking towards the receiver.

As shown in FIGS. 14-21, barrel locking lugs 103 extend radially outwards from exterior surface 101 of barrel extension 100 in a circumferentially spaced apart and opposing relationship. Machined depressions 171 may be formed between the barrel locking lugs 103. As best shown in FIG. 18, by way of example without limitation, eight barrel locking lugs 103 may be provided that correspondingly engage eight splines 81 formed on barrel nut 80. Other suitable numbers of splines 81 and barrel locking lugs 103 may be used. Preferably, the barrel locking lugs 103 have a uniform circumferential spacing such that the lugs are equally spaced around the circumference of barrel extension 100. In one exemplary embodiment, the radial centerline of each barrel locking lugs 103 is angularly arranged at an angle A6 of about +/−45 degrees from each other (see FIG. 18) wherein eight lugs are provided.

In a preferred embodiment, each barrel locking lug 103 includes a front radial locking surface 104 for engaging and interlocking with a corresponding complementary rear radial locking surface 88 on spline 81 of barrel nut 80. Accordingly, barrel locking lugs 103 provide a first locking mechanism for securing barrel extension 100 to barrel nut 80 with an associated compressive locking force F1 (see FIG. 4). Front radial locking surface 104 is oriented generally transverse to longitudinal axis LA when barrel extension 100 is assembled to barrel 31. Preferably, front radial locking surface 104 is disposed at angle A3 with respect to contact surface 115 of barrel extension 100 a shown in FIG. 14. In one exemplary embodiment, angle A3 may be at least about 90 degrees, and about +/−100 degrees in one exemplary preferred embodiment (allowing for fabrication/machining tolerances). Other suitable angles may be used.

Figure 16:
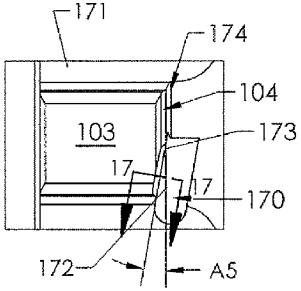
FIG. 16 is a view of detail 16 in FIG. 15 showing a barrel locking lug of the barrel extension.
Figure 17:
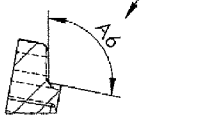
FIG. 17 is a cross-section of the barrel locking lug of FIG. 16 taken along line 17-17.

With reference to FIGS. 15-17 and 19, camming notches 170 may be provided in some embodiments. Camming notches 170 may have a rounded entry portion in some embodiments as shown for receiving radial locking surface 88 on spline 81 of barrel nut 80. Preferably, camming notches 170 are cut at least partially into front radial locking surface 104 of each barrel locking lugs 103 in a preferred embodiment (best shown in FIGS. 16-17). Each camming notch 170 extends partially across front radial locking surface 104 as best shown in FIG. 16. Each camming notch 170 preferably is cut at an angle A5 to the base 174 of locking surface 104 (see FIG. 16) which extends in a transverse direction perpendicular or 90 degrees to longitudinal axis LA of rifle 20 in a preferred embodiment. In some exemplary embodiments, without limitation, angle A5 may be be at least 5 degrees, and more preferably at least about 10 degrees. Camming notch 170 may be formed with an entrance portion 172 and an opposite exit portion 173, which may the same or narrow in width than the entrance portion.

Camming notches 170 impart an axial relative motion to barrel extension 100 in relation to barrel nut 80 due to the angled orientation of at least a part of the notches with respect to the longitudinal axis LA of barrel assembly 30. The camming notches 170 function to translate rotational motion of barrel extension 100 into axial motion. The camming notches 170 advantageously tightens and enhances the locking relationship between the barrel locking lugs 103 and the tapered contact surface 161 of barrel extension 100 (see FIG. 15) and barrel nut 80 as further described below. This produces a zero-clearance fit both axially and radially between the barrel nut 80 and the barrel extension 100. By the contact between barrel extension radial locking surface 104 and barrel nut groove surface 88 (FIG. 11), the barrel extension 100 (and thereby the entire barrel assembly) is pulled rearward, engaging the barrel extension tapered contact surface 161 (see FIG. 15) with the front edge 265 of the barrel nut (shown in FIGS. 10 and 12). It should be noted that camming notch 170 best shown in FIGS. 15 and 16 is a lead-in so that precise alignment of front radial locking surface 104 (extension lug front face) with rear radial locking surface 88 (also the front surface of barrel nut locking groove 87) is not necessary—notch 170 aligns them when torque is applied by turning the barrel assembly into the barrel nut. Radially-extending annular flange 112 on barrel extension 100 in front of the tapered contact surface 161 serves to prevent over insertion of the barrel extension into the barrel nut 80. In addition, calming notch 170 progressively increases the frictional and compressive engagement between front radial locking surface 104 of barrel locking lugs 103 and rear radial locking surface 88 of splines 88 as the barrel extension 100 is rotated into engagement with barrel nut 80 in relation to the first locking mechanism described above.

Figure 10:
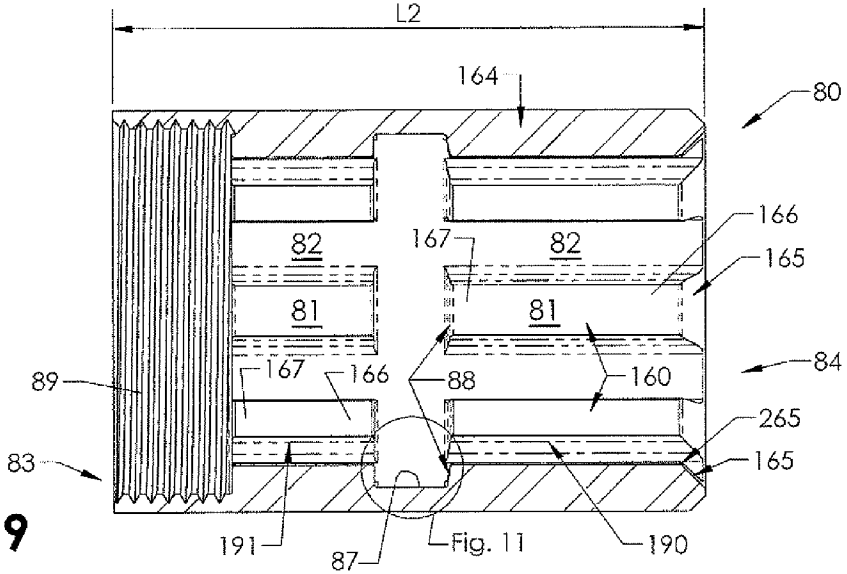
FIG. 10 is a cross-sectional view of the barrel nut.
Figure 11:
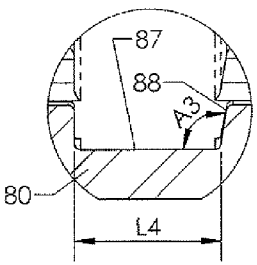
FIG. 11 is a view of detail 11 in FIG. 10.

With continuing reference to FIGS. 15-17 and 19, camming notch 170 is sized and configured to engage rear radial locking surface 88 of splines 81 (see FIGS. 10-11). After fully inserting barrel extension 100 into barrel nut 80 and locating barrel locking lugs 103 in locking groove 87 of the barrel nut, rotating the barrel extension towards a locking position will initially engage a leading edge of rear radial locking surface 88 of spline 81 (at rear end 167) with the entrance portion 172 of notch 170. The rear end 167 of spline 81 travels in notch 170 and slides across front radial locking surface 104 of the barrel locking lugs 103 towards the narrow exit portion 173 of the notch. Continuing to rotate barrel extension 100 causes the leading edge of spline 81 to leave notch 170 until rear radial locking surface 88 of spline 81 fully engages front locking surface 104 of barrel locking lugs 103. The notch 170 imparts axial motion to barrel extension 100 in relation to barrel nut 80 in a manner that displaces the barrel extension slightly rearward due to the angled A5 orientation of notch 170. This both tightens the locking engagement between the barrel locking lugs 103 and splines 81 (see FIG. 4, compressive locking force F1), and also compresses rear angled locking surface 163 of flange 112 against front angled locking surface 165 of each spline as the barrel extension is drawn rearward in relation to barrel nut 80 (see FIG. 4, compressive locking force F2). Accordingly, each end 166, 167 of splines 81 become wedged between the barrel extension flange 112 and barrel locking lugs 103 to form a secure locking relationship between the barrel extension 100 and barrel nut 80. Referring to FIG. 4, compressive locking forces F1, F2 act in opposite and converging directions on either end of splines 81 to produce the wedging effect on the splines.

With continuing reference to FIGS. 14-21, front end 108 of barrel extension 100 includes radially-extending annular flange 112 which in some embodiment provides additional locking engagement between the barrel extension and barrel nut 80. Accordingly, flange 112 provides a second locking mechanism for securing barrel extension 100 to barrel nut 80, which preferably is spaced axially apart from a first locking mechanism provided by barrel locking lugs 103. Flange 112 preferably is located and dimensioned to also properly position barrel locking lugs 103 in locking groove 87 of barrel nut 80 when barrel extension 100 is seated therein and prevent over insertion of the barrel extension into the barrel nut. Preferably, flange 112 is located proximate to front end 108 of barrel extension 100. In other embodiments contemplated, flange 112 may be spaced inwards from front end 108. A rear facing portion of flange 112 defines a rear angled locking surface 163 for cooperatively engaging a complementary front angled locking surface 165 defined on a front end 166 of each spline 81 (as best shown in FIG. 10) to lock barrel extension 100 to barrel nut 80. This creates a compressive locking force F2 between flange 112 and splines 81, as shown in FIG. 4. Preferably, rear angled locking surface 163 and front angled locking surface 165 are both angled as shown in FIG. 4 to provide both an axial and radial interlock that reduces rattling and vibration between barrel extension 100 and barrel nut 80 when rifle 20 is discharged. Rear angled locking surface 163 preferably is circumferentially continuous around barrel extension 100 thereby forming a part of a cone in configuration. Although a continuous flange 112 is preferred for ease of manufacturing, in other embodiments (not shown), flange 112 may be circumferentially discontinuous to define a plurality of separate annular segmented rear angled locking surfaces 163 for engaging front angled locking surfaces 165 of splines 81. Front angled locking surface 165 of barrel nut 80 is preferably disposed on front end 166 of each spline 81 opposite from rear end 167 of the spline having rear radial locking surface 88. Accordingly, each spline defines two opposite facing locking surfaces 88, 165 for engaging barrel extension 100 by wedging each spline between barrel extension flange 112 and barrel locking lugs 103 by compressive locking forces F1, F2 (see FIG. 4) as further described herein. When barrel extension 100 is full inserted into barrel nut 80 and rotated therein, rear and front angled surfaces 163 and 165 respectively become compressed together and frictionally engaged due to the rearward axial displacement of barrel extension 100 by barrel extension camming notches 170 described elsewhere herein. In one exemplary embodiment, angled locking surfaces 163, 165 may each be angled at about +/−45 degrees to longitudinal axis LA. Other suitable angles larger or smaller than 45 degrees may be used however. Preferably, angled locking surfaces 163 and 165 have approximately the same angles, but with opposite front/rear orientations.

It will be appreciated that in some embodiments, the foregoing second locking mechanism formed between rear angled locking surface 163 on flange 112 of barrel extension 100 and complementary front angled locking surface 165 defined on a front end 166 of each spline 81 in barrel nut 80 (as best shown in FIG. 10) may not be required. In some embodiments, the locking mechanisms provided by (1) barrel locking lug front radial locking surface 104 and corresponding complementary rear radial locking surface 88 on spline 81 of barrel nut 80, and (2) the tapered contact surface 161 of barrel extension 100 and barrel nut 80 described elsewhere herein may be sufficient to secure the barrel extension (and barrel assembly) to the barrel nut and upper receiver 42. Accordingly, flange 112 on barrel extension 100 may be sized and configured such that rear angled locking surface 163 on flange 112 may not engage front angled locking surface 165 of barrel nut 80.

A locator pin 113 may be fitted through hole 116 in the top center of barrel extension 100 (see e.g. FIGS. 13 and 18) to prevent the barrel extension from over-rotating during assembly/disassembly for smooth removal, and for proper orientation during the installation of the barrel extension (and thereby the barrel assembly) into the barrel nut 80.

In a preferred embodiment, referring to FIGS. 14-15 and 19-20, a portion of annular surface 114 of barrel extension 100 defines a tapered contact surface 161 as already noted herein to form a third locking mechanism between the barrel extension and barrel nut 80 to now be further described. Tapered contact surface 161 forms a frustoconical portion that extends circumferentially in an annular band or ring around exterior surface 101 of barrel extension 100. Tapered contact surface 161 engages at least a portion of the axial contact surface 160 (see FIG. 9) of each barrel nut spline 81 to form a frictional lock between the barrel extension and barrel nut when these two components are locked together. This creates a compressive locking force F3 between tapered contact surface 161 and splines 81, as shown in FIG. 4. In one embodiment, tapered contact surface 161 may be disposed adjacent to flange 112 of barrel extension 100. This creates a frictional lock proximate to the front of barrel nut and forward of barrel locking lugs 103 (see FIG. 4) at an axial locking location different than and spaced part from the axial locking location formed by barrel locking lugs 103 and the barrel nut. Engagement between tapered contact surface 161 of barrel extension 100 and axial contact surface 160 of splines 81 form an intermittent pattern of contact extending circumferentially around barrel extension 100. Tapered contact surface 161 in a preferred embodiment has an increasing slope in the axial direction from the rear point P1 of surface 161 to the front point P2 of surface 161 behind flange 112 such that an outer diameter D1 measured at P2 is larger than outer diameter D2 measured at P1 (see e.g. FIG. 14). When barrel extension 100 is fully inserted and seated in barrel nut 80, an axial contact pressure zone 115 is formed between a forward portion of each spline 81 near front end 166 along axial contact surface 160 and tapered contact surface 161 as shown in FIG. 4. In one exemplary embodiment, without limitation, tapered contact surface may have a representative axial length of at least about 0.125 inches measured between points P1 and P2.

Figure 19:
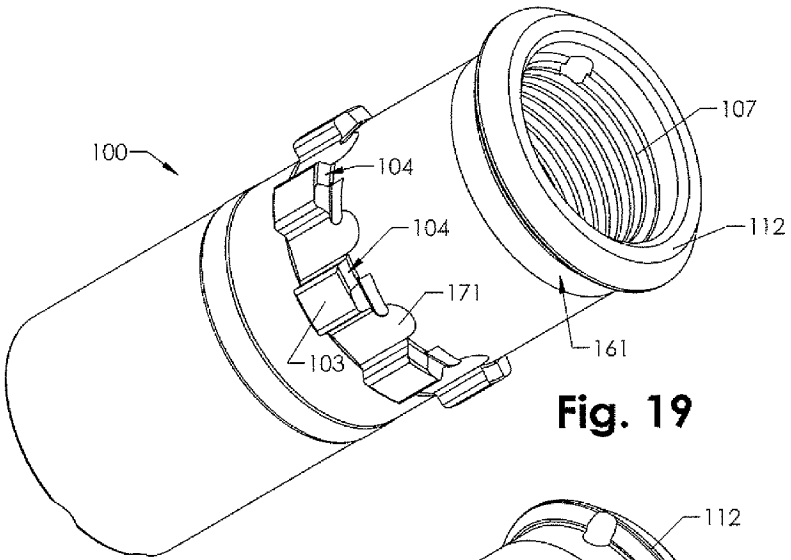
FIGS. 19 and 20 are perspective views looking towards the muzzle end and breech end of the barrel extension, respectively.
Figure 20:
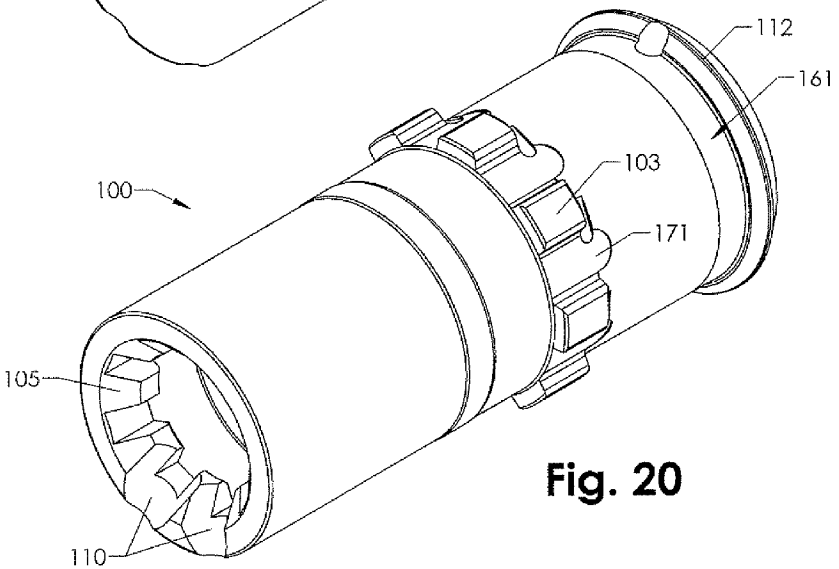

FIGS. 4 and 13 shows barrel extension 100 installed onto barrel 31. FIG. 18 shows an end view of barrel extension 100 with the foregoing features identified. FIGS. 19 and 20 show different perspective views of the barrel extension 100 with the foregoing features identified.

Figure 9:
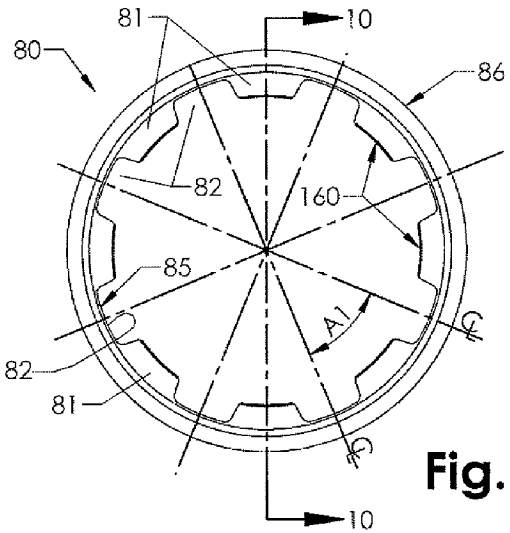
FIG. 9 is an end view of the barrel nut of the rifle looking towards the breech end of the barrel nut.
Figure 12:
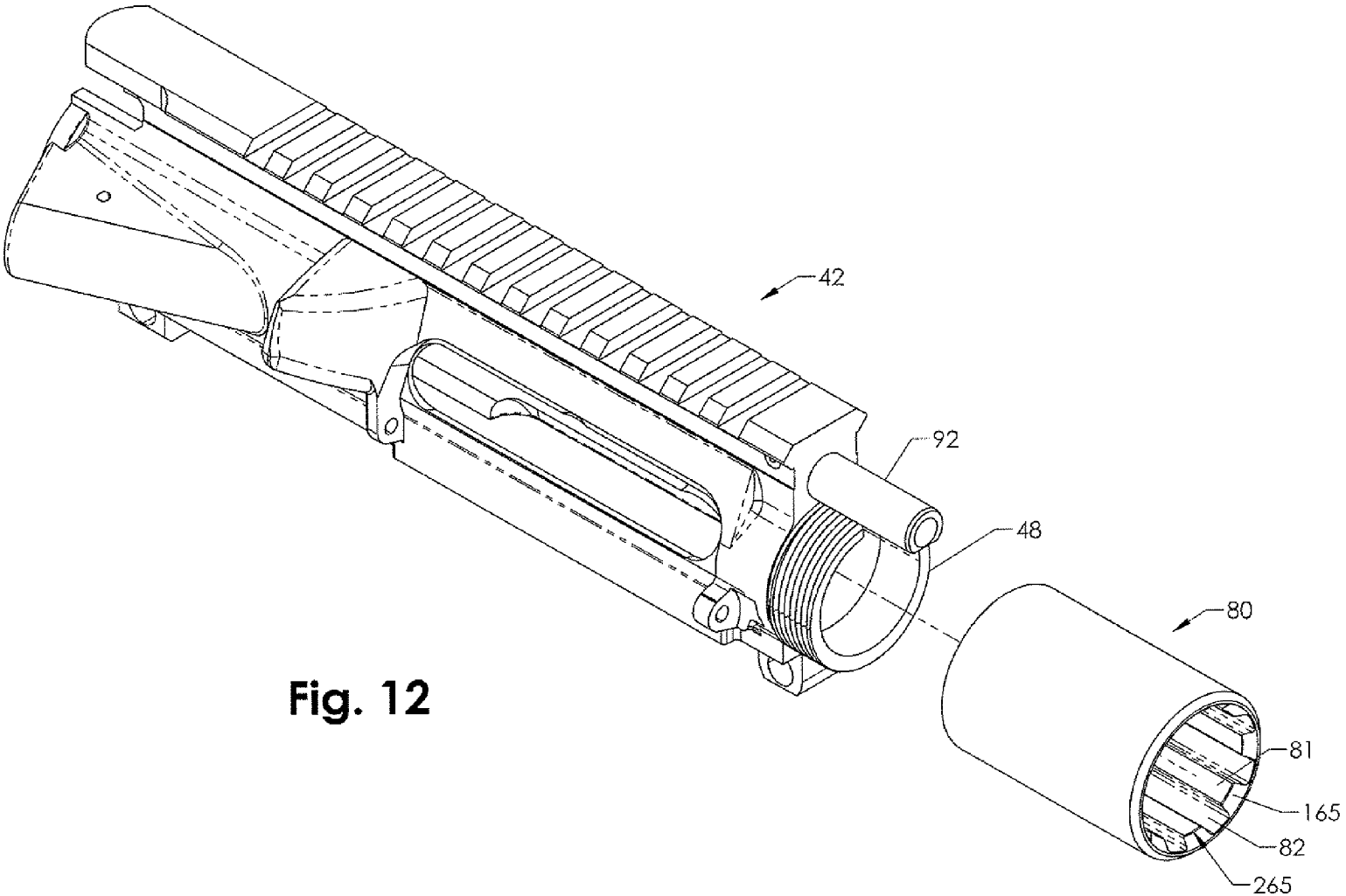
FIG. 12 is a perspective view of the upper receiver and barrel nut.

Barrel Nut: Barrel nut 80 will now be described in further detail. FIGS. 9-11 depict a preferred embodiment of barrel nut 80. FIG. 9 is an end view of barrel nut 80. FIG. 10 is a longitudinal cross-sectional view of barrel nut 80. FIG. 11 shows a detail of barrel nut 80 taken from FIG. 10. FIG. 12 shows barrel nut 80 positioned for attachment to upper receiver 42.

Referring now to FIGS. 9-12, barrel nut 80 according to principles of the present invention is a generally tubular element and includes an axial length L2, a receiver end 83, a barrel end 84, an exterior surface 86, and an interior surface 85. Barrel nut 80 is cooperatively sized and configured with barrel extension 100 to removably receive at least a portion of barrel extension 100 therein.

Barrel nut 80 may be removably or permanently coupled to upper receiver 42. In one possible embodiment, shown in FIG. 12, barrel nut 80 may be removably attached to upper receiver 42 via a threaded connection. Referring to FIG. 10, a portion of interior surface 85 adjacent receiver end 83 of barrel nut 80 may have internal threads 89 configured to removably engage a complementary externally-threaded mounting nipple 48 disposed on the front of upper receiver 42 (see FIGS. 3 and 12). Barrel nut 80 extends in an forward axial direction from the front of upper receiver 42 when mounted thereto. In other possible embodiments contemplated, a portion of exterior surface 86 of barrel nut 80 may alternatively be threaded while the mounting nipple 48 on upper receiver 42 may have complementary internal threads. In some embodiments, barrel nut 80 may also be pinned to upper receiver 42 in addition to threading for a more permanent type installation.

Although threaded attachment of barrel nut 80 to upper receiver 42 is preferred, in other possible embodiments barrel nut 80 may be attached to upper receiver 42 by other commonly known means for assembling firearm components such as set screws, pinning, clamping, etc. Preferably, barrel nut 80 is attached externally to upper receiver 42 to allow the barrel nut to sized larger than if mounted inside the receiver. In some conventional designs having an internal locking sleeve, the barrel locking function and headspacing is done by a trunnion. This means that headspacing will vary from firearm to firearm. When wear pushes the trunnion out of headspacing, the entire firearm such as a rifle must be replaced. In embodiments according to the present invention, since the headspacing is done by the assembly of the barrel extension to the barrel instead, only the quick change barrel would need to be replaced.

In a preferred embodiment, with reference to FIGS. 9-12, barrel nut 80 includes a plurality of locking elements such as splines 81 for engaging and interlocking with barrel locking lugs 103 of barrel extension 100. Splines 81 are preferably arranged in diametrically opposing relationship and circumferentially spaced apart from each other along the interior surface 85 of the barrel nut. Splines 81 extend radially inwards from interior surface 85 of barrel nut 80. In a preferred embodiment, splines 81 are sized and configured to engage both barrel locking lugs 103 and flange 112 of barrel extension 100. Splines 81 may be elongated and extend in a longitudinal direction in barrel nut 80. Each spline includes a front end 166 and a rear end 167 (with the orientation being defined when barrel nut 80 is attached to upper receiver 42 of rifle 20, as shown in FIGS. 4 and 12). In one embodiment shown in FIG. 10, splines 81 preferably extend at least proximate to barrel end 84 of barrel nut 80 to assist with guiding barrel extension 100 into the barrel nut. Accordingly, front end 166 of spline 81 may terminate at barrel end 84 of barrel nut 80. In other embodiments, splines 81 may be spaced inwards from one or both ends 83, 84 of barrel nut 80. Splines 81 may have any suitable axial length. Preferably, splines 81 do not extend into the threads 89 of barrel nut 80.

In the preferred embodiment, the barrel extension 100 is configured and arranged to preferably engage both front and rear ends 166, 167 of at least some of the splines 81 to lock the barrel extension to the barrel nut 80, and more preferably the barrel extension engages all of the splines. As described herein, this is provided by barrel extension 100 including axially spaced-apart opposing surfaces that engage front and rear ends 166, 167 of the splines 81, which in some embodiments is provided by front radial locking surface 104 of barrel locking lugs 103 and rear angled locking surface 163 of flange 112.

Any suitable number of splines 81 may be provided so long as a secure locking relationship may be established between barrel unit 30 and rifle 20. In a preferred embodiment, the number of splines 81 may match the number of barrel locking lugs 103 of barrel extension 100. In one embodiment, by way of example as shown in FIGS. 9-11 without limitation, eight raised splines 81 may be provided that correspond with eight barrel locking lugs 103. Other suitable numbers of splines 81 and barrel locking lugs 103 may be used. Preferably, the splines 81 have a uniform circumferential spacing such that the splines are equally spaced around the circumference of barrel nut 80. In one exemplary embodiment, the radial centerline of each spline 81 is angularly arranged at an angle A1 of about +/−45 degrees from each other (see FIG. 9) wherein eight splines are provided.

With continuing reference to FIGS. 9-11, splines 81 define longitudinally-extending channels 82 formed between pairs of splines along interior surface 85 of barrel nut 80 for slidably receiving therein complementary configured and dimensioned barrel locking lugs 103, which in one preferred embodiment may be formed on a barrel extension 100 as further described herein. Splines 81 and/or channels 82 preferably extend at least partially along the axial length L2 of barrel nut 80. In addition, splines 81 and/or channels 82 may include continuous or intermittent portions disposed along the length L2 of the barrel nut 80.

Referring now to FIG. 10, barrel nut 80 preferably includes an annular locking groove 87 that receives and locates barrel locking lugs 103 of barrel extension 100. Locking groove 87 extends circumferentially along interior surface 85 of the barrel nut. Preferably, in one embodiment, locking groove 87 is oriented transverse and perpendicular to longitudinal axis LA of rifle 20. Locking groove 87 communicates with longitudinally-extending channels 82 such that barrel locking lugs 103 may be slid along the channels and enter the groove when barrel extension 100 is inserted into barrel nut 80. When barrel locking lugs 103 are positioned in locking groove 87, barrel extension 100 and barrel 31 attached thereto may be rotated to lock and unlock the barrel from the barrel nut 80 and rifle 20. In a preferred embodiment, locking groove 87 bisects splines 81 to define a group of front splines 190 and rear splines 191 on either side of the groove as shown. In a preferred embodiment, front splines 190 disposed forward of locking groove 87 define active locking elements of barrel nut 80 which engage barrel extension 100 to secure the barrel extension to the barrel nut. This group of front splines 81 is wedged between annular flange 112 and barrel locking lugs 103 of barrel extension 100 for detachably and rotatably locking barrel assembly 30 to rifle 20 in a manner further described herein. In some embodiments contemplated (not shown), rear splines 191 may be omitted or need not contribute to assisting with locking the barrel extension 100 to barrel nut 80.

With additional reference to FIG. 11, a rear portion of each spline 81 defines rear radial locking surface 88 for mutually engaging a corresponding and complementary configured front radial locking surface 104 formed on barrel locking lugs 103. Rear radial locking surface 88 on spline 81 is preferably disposed at angle A2 to interior surface 85 of barrel nut 80. Preferably, interior surface 85 is oriented generally parallel to longitudinal axis LA of rifle 20 in some embodiments. In one exemplary embodiment, angle A2 may be at least about 90 degrees, and more preferably at least about 100 degrees allowing for fabrication tolerances. Other suitable angles larger than 90 degrees may be used. It is well within the ambit of one skilled in the art to determine and select a suitable angle A2 for locking surface 88 and angle A3 for locking surface 104 of barrel locking lugs 103 (see FIG. 14). Barrel nut splines 81 and barrel locking lugs 103 preferably each have a complementary radial height selected such that barrel locking lugs 103 cannot be axially removed from inside annular locking groove 87 when locking lugs 103 are radially aligned behind the splines and positioned in the groove.

In a preferred embodiment, splines 81 each define an axial contact surface 160 for engaging a portion of annular tapered contact surface 161 of barrel extension 100, as shown in FIGS. 9 and 10 and described elsewhere herein in greater detail. When barrel extension 100 is inserted into barrel nut 80, a forward portion of each axial contact surface 160 will engage at least a portion of tapered contact surface 161.

In contrast to prior known cast or extruded barrel aluminum barrel nuts, barrel nut 80 in the preferred embodiment is made of steel for strength and ductility since barrel assembly 30 locks directly into the barrel nut. In one preferred embodiment, barrel nut 80 may be forged to provide optimum strength, and more preferably may be forged using a commercially-available hammer mill and process generally described in commonly assigned copending U.S. patent application Ser. No. 11/360,197 (Publication No. 2007/0193102 A1), which is incorporated herein by reference in its entirety. Forging provides barrel nut 80 with greater strength and ductility than cast steel. Preferably, barrel nut 80 is made of a steel or steel alloy commonly used in the art for firearm components and suitable for forging. Barrel nut 80 may be forged in the hammer mill by slipping a tubular steel blank or workpiece over a steel barrel nut form having a reverse impression of splines 81 and channels 82. The steel blank is then rotated continuously and simultaneously fed axially through a series of circumferentially-spaced and diametrically-opposed reciprocating impact hammers. The impact hammers strike the exterior surface of the steel blank, which displaces and forces the metal into a shape conforming to the barrel nut form to produce internal splines 81 and channels 82. Locking groove 87, locking surfaces 88, 165 on splines 81, threads 83, and other features may subsequently be machined using conventional techniques well known to those skilled in the art. In some embodiments, for example, the foregoing features of barrel nut 80 may be cut on a CNC turning center (lathe) except for the orientation pin 113 slot that may be milled into the face of the barrel nut during assembly, which may be done in a vertical machining center (CNC vertical milling machine).

Figure 7:
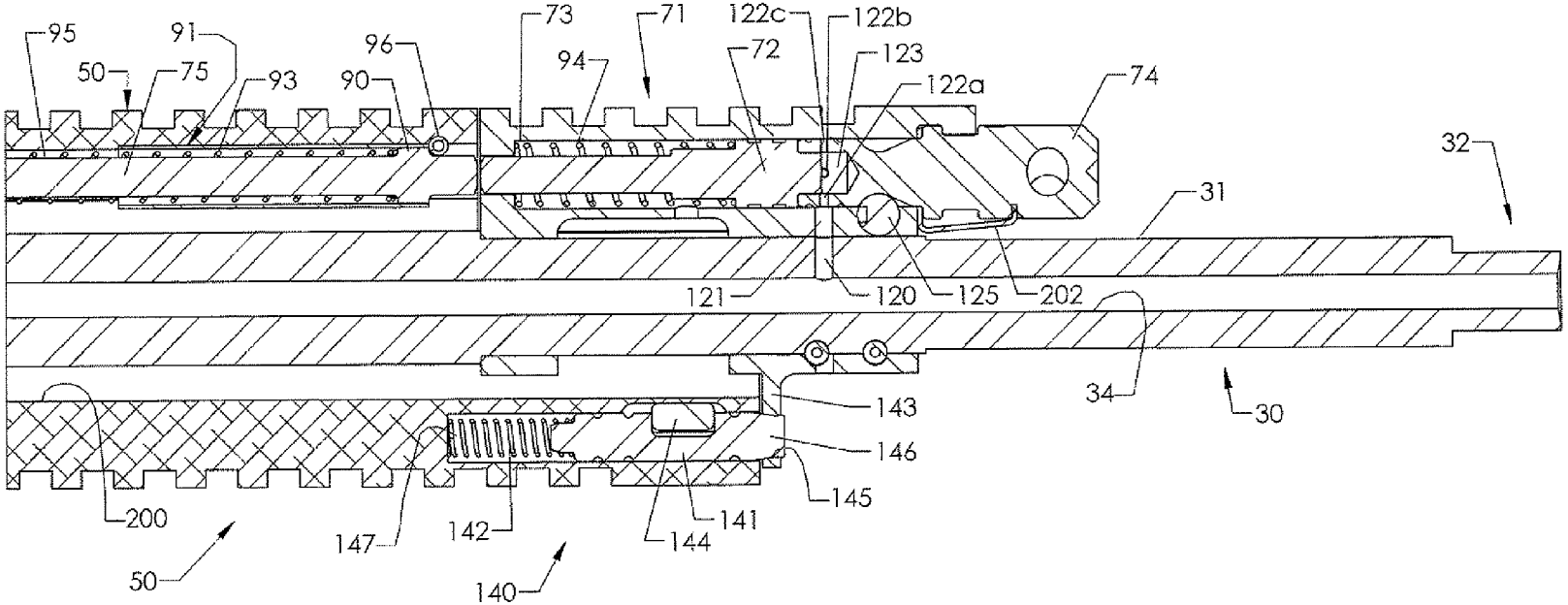
FIG. 7 is a partial cross sectional view of the muzzle end of the barrel.
Figures 8A, 8B:
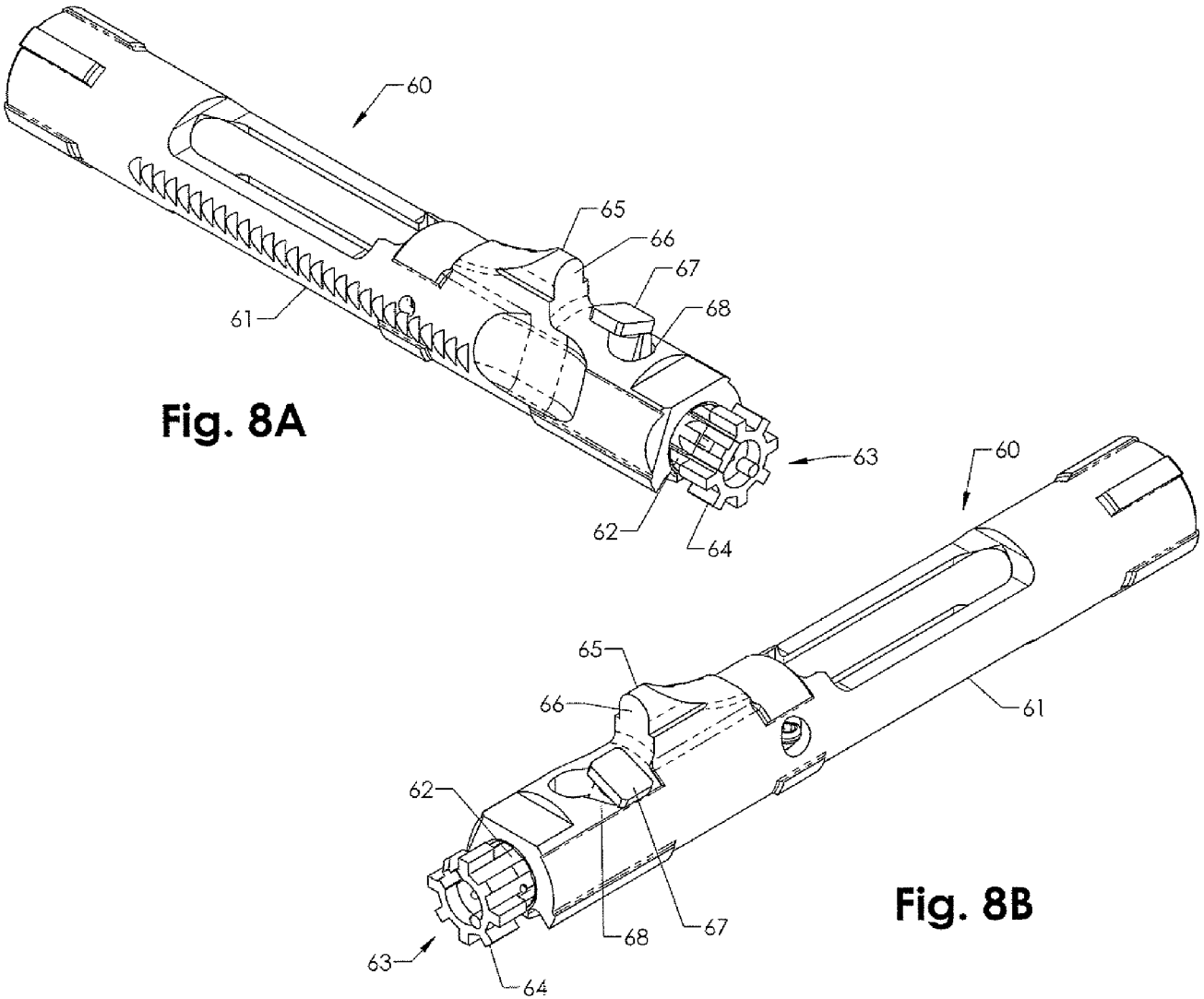
FIG. 8 is a perspective view of the reciprocating bolt assembly with rotating bolt of the rifle.

Handguard: In a preferred embodiment, a handguard 50 may be provided as shown in FIGS. 1, 3, and 7 to protect the users hands from direct contact with a hot barrel 31 after discharging rifle 20. Handguard 50 includes a top, bottom and side portions that extend longitudinally forward from upper receiver 42. Handguard 50 may be of unitary construction or separate top, bottom and side portions that may be permanently or detachably attached together. Preferably, handguard 50 is mounted to upper receiver 42 in a manner such that the handguard is supported by the upper receiver independently of the barrel assembly 30. In one possible embodiment, as shown in FIG. 4, handguard 50 may be coupled to upper receiver 42 by a transverse-mounted pins 270, 271. Bottom pin 270 may be pinned partially through barrel nut 80. Top pin 271 may be pinned partially through tubular bushing 92 affixed to upper receiver 42. In one exemplary embodiment, top pin 271 may be a coiled spring pin or a solid pin. This mounting arrangement allows the barrel assembly 30 to be removed and replaced from rifle 20 while handguard 50 remains in place attached to upper receiver 42. Advantageously, it is not necessary in the preferred embodiments to remove handguard 50 or portions thereof in order to gain access to a barrel nut or other retaining member unlike prior known designs for removing the barrel. Accordingly, the preferred embodiment of a barrel retaining system is intended to reduce the time required to change barrels and eliminate the need to tools. As best shown in FIG. 7, handguard 50 defines an longitudinally-extending internal chamber 53 having a forward-facing opening to receive and house barrel 31.

In one embodiment, as shown if FIG. 1, at least a portion of handguard 50 is preferably provided with accessory mounting rails 52, such as Picatinny-style rails per US Government Publication MIL-STD-1913 Revision 10 (July 1999) or a similar suitable handguard. These rails allow a variety of accessories to be mounted to rifle 20 such as scopes, grenade launchers, tactical flashlights, etc. as conventionally used with field-type rifles. In one embodiment, upper receiver 42 may include accessory mounting rails 52 as shown.

Figures 5, 6A, 6B:
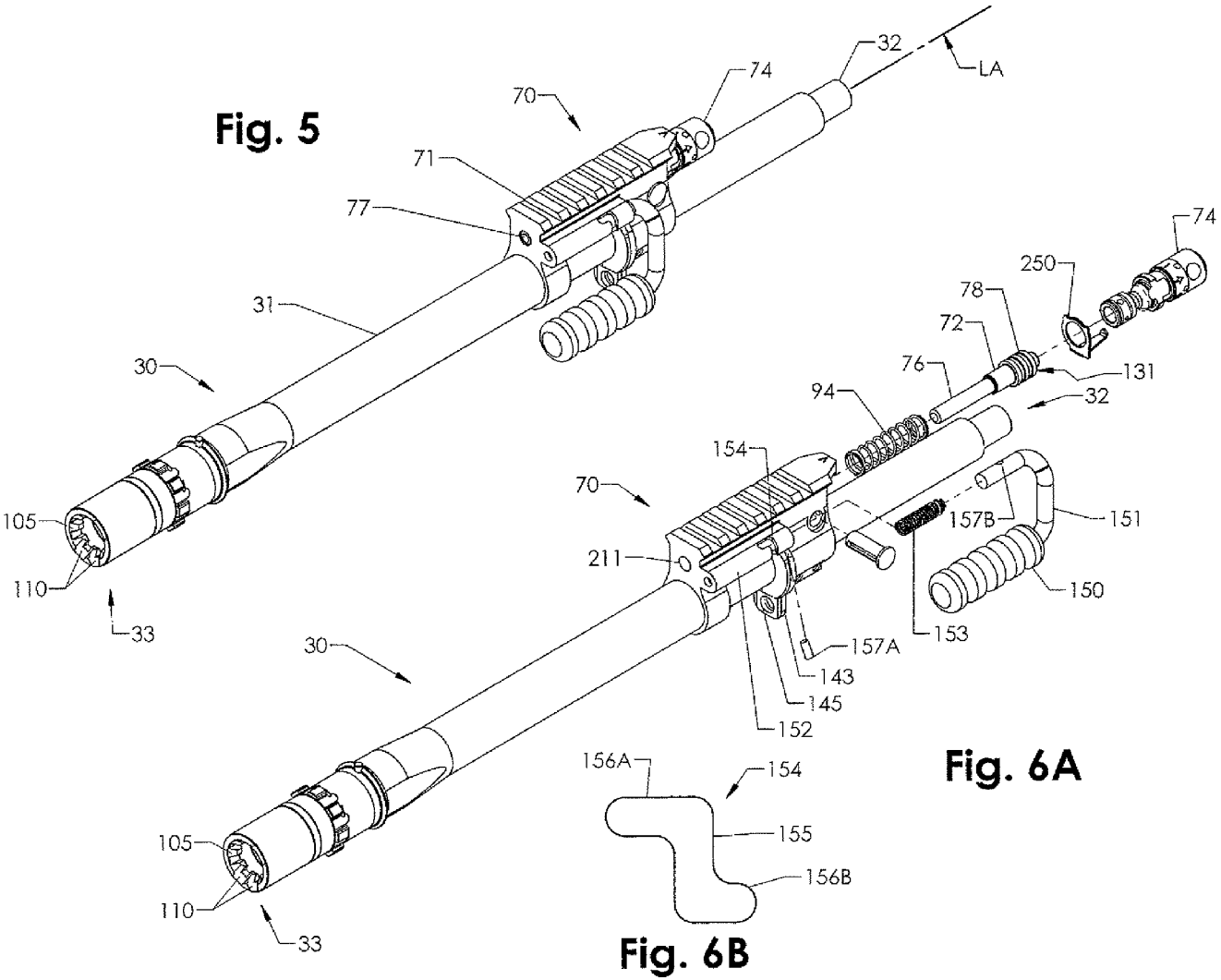
FIG. 5 is a perspective assembled view of the quick-change barrel assembly of the rifle.

Gas Piston System: In a preferred embodiment, rifle 20 includes a gas piston operating system 70 which automatically cycles the action of the rifle. FIGS. 5 and 6 show a perspective view and exploded perspective view, respectively, of the gas piston system 70 and gas block 71 with respect to barrel assembly 30. FIG. 7 shows a perspective view of the gas block alone.

Referring now to FIGS. 2, 3, and 5-7, gas piston operating system 70 generally includes gas block 71, a cylindrical piston bore 73 defined therein, a gas piston 72 slidably received in piston bore 73, variable pressure regulator 74, and transfer rod 75. In one embodiment, gas block 71 may be attached to barrel 31 towards the front portion of the barrel by any suitable conventional known means (e.g. pinning, clamping, screws, etc.) and preferably is spaced rearwards from muzzle end 32 as shown. A portion of the combustion gases are bled off from barrel bore 34 and routed to piston bore 73 via (in sequence) port 120 in barrel 31, conduit 121 in gas block 71, one of a plurality of manually selectable lateral orifices in pressure regulator 74 such as orifices 122*a*-122*d*, and axial passageway 123 which opens rearward into piston bore 73 as best shown in FIG. 7. In a preferred embodiment, gas block 71 is mounted on top of barrel 31. Gas block 71 further defines an external vent 201 which is fluidly connected to the exterior of rifle 20 for venting combustion gases after piston head 78 axially passes rearward of the vent when the gas piston system 70 is actuated upon firing the rifle (see FIG. 26).

Figure 21:
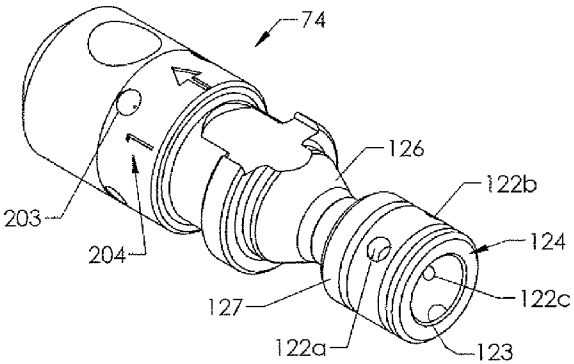
FIG. 21 is a perspective view of the gas pressure regulator of the gas operating system of the rifle.
Figure 28:
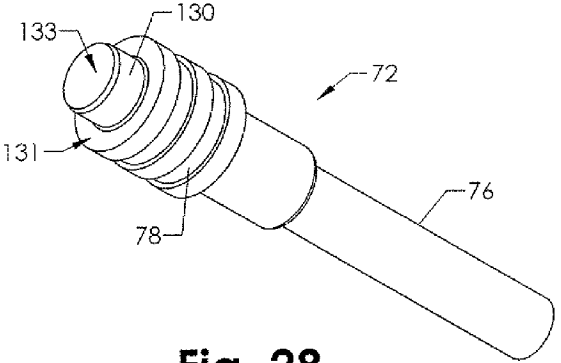
FIG. 28 is a second perspective view of the gas piston of FIG. 23.
Figure 24:
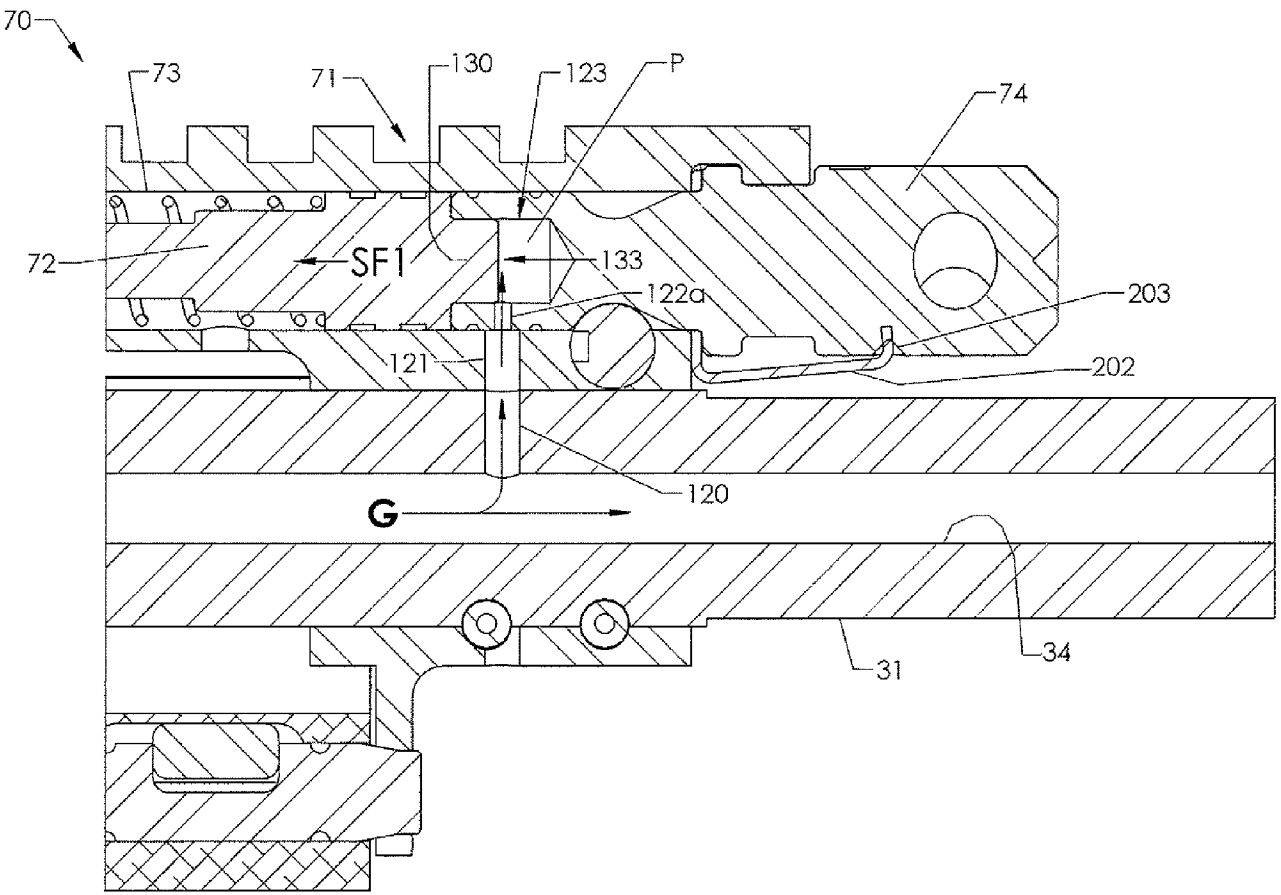
FIG. 24 is a partial cross-sectional view of the gas piston system showing the piston in a first initial position after discharging the rifle.
Figure 25:
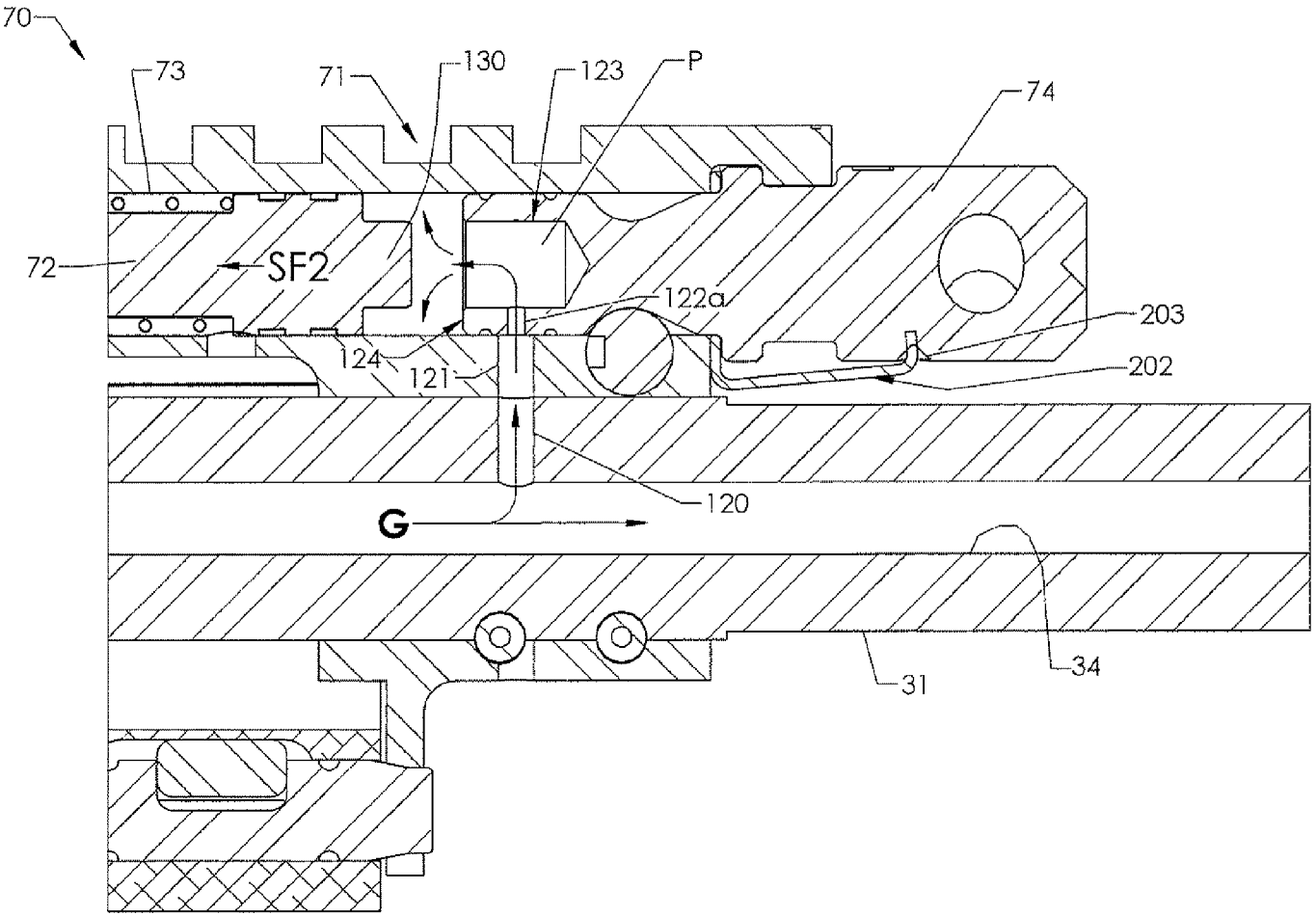
FIG. 25 is a partial cross-sectional view of the gas piston system showing the piston in a second subsequent position after discharging the rifle.
Figure 26:
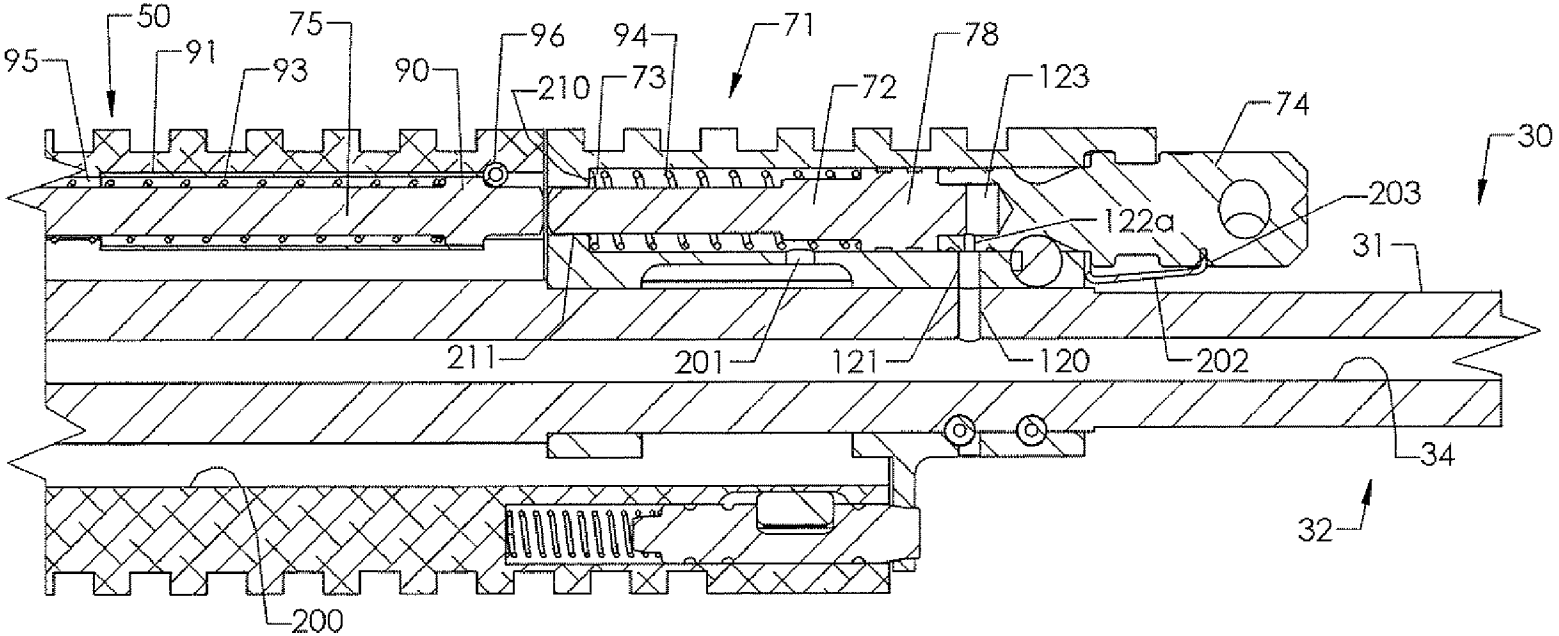
FIG. 26 is a partial cross sectional view of the muzzle end of the barrel showing an alternative embodiment of a gas block of the gas piston system having a single fixed diameter orifice in lieu of a pressure regulator.

Referring to FIGS. 7 and 21, pressure regulator 74 is a generally cylindrical component in a preferred embodiment that is rotatably received in the forward portion of piston bore 73. In one embodiment, pressure regulator 74 may be held in gas block 71 via lateral pin 125 that is received in a complementary-shaped annular groove 126 formed in the pressure regulator. However, other suitable means of securing pressure regulator 74 in gas block 71 may be used so long as regulator 74 remains rotatable. Pressure regulator 74 includes a rear face 124 that abuts front face 131 of piston 72 (see e.g. FIGS. 6A and 28) when both components are mounted in gas block 71. Rear face 124 defines a front end wall of piston bore 73 and an opposite end wall 210 may be formed by gas block 71. Axial passageway 123 opens through rear face 124 and preferably extends forward partially through the length of pressure regulator 74. A plurality of orifices 122*a*, 122*b*, 122*c*, and 122*d* (not shown, but opposite orifice 122*b* in FIG. 7) are provided which extend laterally through the sidewall 127 of pressure regulator 74 and communicate with axial passageway 123. Preferably, each orifice 122*a*-122*d* is configured similarly, but has a different diameter than all other orifices to allow the combustion gas flow quantity and corresponding operating pressure to be selectably varied by the user upon rotating different orifices into lateral alignment with conduit 121 of gas block 71 and port 120 of barrel 31 (see FIG. 7). This is intended to allow the user to vary the pressure in piston bore 73 for proper operation of the gas piston system 70 and cycling of the spring-loaded action based on the type of ammunition being used, length of barrel, or other factors which may affect the operating pressure of the gas piston system. In some embodiments, after the user selects a desired orifice 112*a*-122*d*, the rotational position of the pressure regulator 74 may be releaseably fixed by a spring clip 202 having one end engaged with gas block 71 and an opposite end which engages one of four circumferentially-spaced detents 203 that are each preferably axially aligned with one of the orifices as shown in FIGS. 24-26. Other suitable means of fixing the position of pressure regulator 74 may be used. Alphanumerical indicia 204 may be provided on pressure regulator 74 as shown in FIG. 21 to assist users with repeatedly selecting various desired orifices 122*a*-122*d*.

Although a preferred embodiment includes a pressure regulator 74, in other embodiments contemplated a non-variable gas pressure system may be provided. The pressure regulator may therefore be replaced by a fixed diameter orifice that fluidly connects port 120 in barrel 31 with the piston bore 73. Accordingly, the invention is not limited in its applicability to any particular variable or non-variable pressure system.

Referring to FIGS. 2 and 5-7, piston 72 includes a cylindrical head 78 having a front face 131 defining a diameter Df and an adjacent cylindrical stem 76 formed integral with or attached to head 78 and extending rearwards. Stem 76 may be stepped in diameter in some embodiments as shown. Piston head 78 in one embodiment may be enlarged with respect to piston stem 76 and may include piston rings (not shown) in some embodiments for sealing between the head and piston bore 73. Preferably, a rear end 77 of piston stem 76 (see FIG. 5) protrudes through a hole 211 in the rear of gas block 71 that penetrates end wall 210 at the rear of piston bore 73. Transfer rod 75 contacts and engages rear end 77 of piston stem 76 in an abutting relationship in a preferred embodiment without a fixed or rigid connection being formed between the transfer rod and piston. Accordingly, transfer rod 75 and piston 72 are preferably separate components that are independently supported and guided in movement so that barrel unit 30 may be removed from rifle 20 without removing the transfer rod, as will be further described herein. In other embodiments contemplated, however, piston 72 may be rigidly coupled to or an integral part of transfer rod 75 (not shown) where a quick-release barrel retaining system as described herein is not desired. In these latter systems, it may still be desirable to pre-tension and eliminate any gaps between bolt carrier key 65 and the rear end of transfer rod 75 according to principles of the present invention.

As shown in FIG. 3, transfer rod 75 extends rearwards into upper receiver 42 to engage bolt carrier key 65 of bolt carrier 61 for cycling the action. The rear end of transfer rod 75 is positioned to contact and engage forward-facing thrusting surface 66 of bolt carrier key 65 in an abutting relationship without a fixed or rigid connection between surface 66 and key 65. The rear portion of transfer rod 75 is slidably supported by upper receiver 42 for axial movement therein. In one embodiment, a tubular bushing 92 may be provided in upper receiver 42 to slidably receive and support transfer rod 75. The front portion of transfer rod 75 is supported by handguard 50 as shown in FIG. 7. In a preferred embodiment, handguard 50 contains a longitudinally-extending cavity 95 that movably receives transfer rod 75. Handguard 50 may include a tubular collar 91 located in the front of the handguard proximate to gas block 71 as shown to support transfer rod 75. In one embodiment, transfer rod 75 may include an annular flange 90 positioned proximate to the front of the transfer rod so that intermediate portions of the rod between flange 90 and bushing 92 do not engage cavity 95. This helps reduce friction and drag on the transfer rod 75 when it is driven rearward by piston 72 to cycle the action after discharging rifle 20.

With continuing reference to FIGS. 2, 3 and 5-7, piston 72 is axially biased in a forward direction by a biasing member such as piston spring 94. Preferably, spring 94 is disposed in piston bore 73 and has one end that abuts gas block at the rear of the piston bore and an opposite front end that acts on piston head 74. Spring 94 keeps piston head 74 abutted against the rear of pressure regulator 74 when the gas piston operating system 70 is not actuated. In a preferred embodiment, transfer rod 75 is axially biased in a forward direction by a separate biasing member such as transfer rod spring 93 as shown in FIGS. 3 and 7. In one embodiment, transfer rod spring 93 is disposed about at least a portion of transfer rod 75 and positioned in cavity 95 of handguard 50 with the transfer rod. Transfer rod spring 93 preferably keeps the front of transfer rod 75 biased toward and preferably against rear end 77 of piston stem 76. Spring 93 has a rear end that abuts upper receiver 42, and in some embodiments bushing 92 as shown. An opposite front end of spring 93 abuts flange 90 on transfer rod 75. Preferably, a travel stop such as transverse pin 96 (see FIG. 7) may be provided to prevent transfer rod 75 from being ejected forward and out from handguard cavity 95 when gas block 71 is removed from rifle 20 as further described herein. Accordingly, in a preferred embodiment, spring-biased transfer rod 75 is self-contained in handguard 50 and rifle 20 independent of the spring-biased piston 72 associated with gas block 71 so that barrel assembly 30 with gas block 71 may be removed from rifle 20 without removing the transfer rod.

With additional reference to FIG. 21, gas piston system 70 includes a piston mechanical linkage pre-tensioning system in a preferred embodiment. In a preferred embodiment, the mechanical linkage may be formed by transfer rod 75 that operably couples the piston to the bolt carrier. In a preferred embodiment, the pre-tensioning system operates essentially by providing at least two stage piston actuation and delayed pressurization of the entire piston bore 73 by the combustion gases bled off from barrel 31 after discharging rifle 20. During the initial partial piston actuation stage, an initial lower pressure force is applied against piston 72 by the combustion gases during which time piston bore 73 preferably is not fully pressurized. This creates an initial partial rearward axial displacement of piston 72 by a distance which is intended to be sufficient to pre-load and tighten up the mechanical linkage (e.g. transfer rod 75) between piston 72 and bolt carrier 61 of the gas piston system without fully cycling the action as further described herein. This initial partial piston actuation stage is followed by a second full piston actuation stage in which full piston actuation and displacement occurs when piston bore 73 is fully pressured by the combustion gases.

Although piston 72 and transfer rod 75 are preferably separate components in the preferred embodiment unlike some known rifle designs in which the piston is formed as an integral forward end of or rigidly connected to the transfer rod (i.e. threaded, pinned, etc.), the pre-tensioning system in essence temporarily replicates a unitary piston-transfer rod construction from an operable standpoint by removing any physical gaps or looseness that may intentionally or unintentionally exist or develop through use and wear between these components prior to full actuation of the gas piston system 70. Advantageously, this is intended to provide the smoother operational benefits of integral transfer rod-piston designs, but still allows the piston 72 and transfer rod 75 to be separate components so that the barrel unit 30 with gas block 71 can be removed from rifle 20 to change barrels without having to remove the transfer rod. The piston mechanism linkage pre-tensioning system therefore intends to improve the smoothness of the preferred two-piece transfer rod-piston arrangement as disclosed herein by minimizing or eliminating rattling and vibration of these separate linkage components (i.e. piston and transfer rod), reduce wear on these linkage components, maintain proper clearances/tolerances between components and minimize impact stresses between contact surfaces of these linkage components to minimize the possibility of metal fatigue fractures developing over repeated cycling of the gas piston system.

In one embodiment, with reference to FIGS. 23-28, a gas piston linkage pre-tensioning system includes a protrusion such as in some embodiments cylindrical thrust stud 130 formed on or attached to piston face 131 on piston head 78 that operably interacts with passageway 123 of pressure regulator 74. Stud 130 projects outwards in an axial direction from piston face 131 towards passageway 123 and is configured and adapted to be slidably received in the passageway 123. Stud 130 is axially movable from an inserted position in which the stud is inserted into passageway 123 to a withdrawn position in which the stud is removed from passageway 123 of pressure regulator 74. Stud 130 is moved between the inserted and withdrawn positions by actuation of the spring-loaded gas piston system 70. Stud 130 preferably has a diameter Ds and length Ls selected in coordination with sizing (i.e. diameter and length) of axial passageway 123 to allow the stud to at least partially enter the pressure regulator 74. In a preferred embodiment, diameter Ds is smaller than diameter Df of piston head 78. Preferably, stud 130 has a length Ls selected that does not obscure orifices 122*a*-122*d* in pressure regulator 74 when the stud is inserted into passageway 123.

In a preferred embodiment, cylindrical thrust stud 130 includes a free end defining an end face 133 and an annular longitudinally-extending side 132. End face 133 is flat in a preferred embodiment to provide a surface that is perpendicular to longitudinal axis LA and upon which the combustion gas pressure will exert a force in an axial direction against piston 72 when the gas is introduced into passageway 123. In some embodiments, side 132 may be straight. In other embodiments, a portion of side 132 may be slightly tapered Ts downwards in diameter in an axial direction from piston face 131 towards end surface 133 of stud 130 to assist with centering and insertion of stud 130 into passageway 123 of pressure regulator 74 during operation of the gas piston system 70.

The force available to drive piston 72 rearwards to cycle the action after discharging rifle 20 is dependent upon the pressure of the combustion gases and surface area of forward piston face 131 upon which the combustion gases exert a force. The piston driving force F (in English units of pounds) is proportional to the surface area SA (in English units of square inches) of piston face 131 acted on by the combustion gases times the pressure P (in English units pounds/square inch) of the combustion gas. The formula may be represented by F=P×SA.

Figure 23:
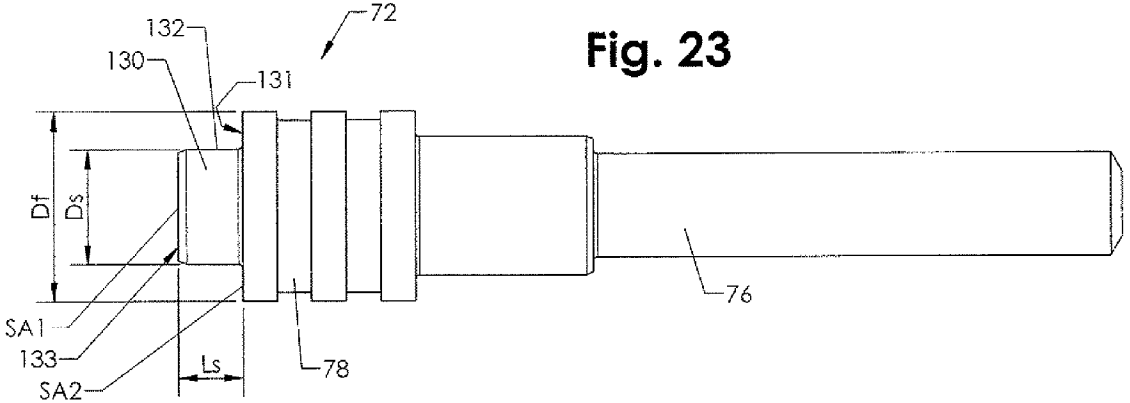
FIG. 23 is a side view of a gas piston of the gas operating system of the rifle.
Figure 27:
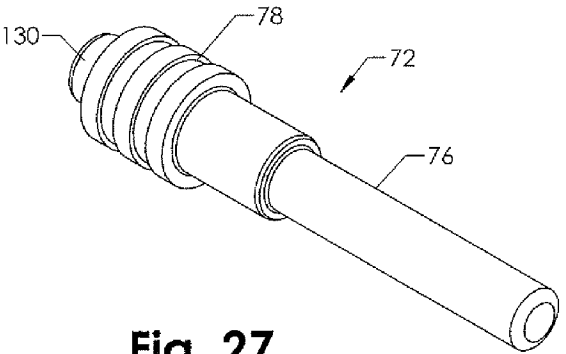
FIG. 27 is a first perspective view of the gas piston of FIG. 23.

Referring to FIGS. 23 and 27, end surface 133 of thrust stud 130 defines a portion of piston face 131 and a surface area SA1. The remainder of piston face 131 defines an annular surface area SA2 circumferentially surrounding thrust stud 130. The total surface area SAT, which will be exposed to the pressure of the combustion gas bleed flow for operating the gas piston system 70 during part of the piston stroke, is SAT=SA1+SA2. Preferably, SA1 is less than SAT, and in some embodiments, may be less than SA2.

The gas piston linkage pre-tensioning system operates in principle by initially exposing a limited surface area of piston face 131 (i.e. SA1 of thrust stud 130) to the combustion gas pressure of the bleed off stream, following by ultimately exposing the entire total surface area (i.e. SAT) of piston face 131 including end surface 133 of stud 130 to the gas pressure. Because SA1 is smaller than SAT, the initial force exerted on piston 72 will be less than the final full force exerted by the combustion gas on the piston when the total surface area SAT is exposed to the gas. Based upon the spring forces (k) selected for transfer rod spring 93 and piston spring 94 which provide resistance against the piston's 72 rearward motion, it is readily within the abilities of those skilled in the art to determine an appropriate surface area SA1 for thrust stud 130 to generate an axial force SF1 sufficient to partially displace piston 72 (first stage piston actuation) against the combined forward biased spring force of springs 93 and 94 in order to pre-tension the gas piston system mechanical linkage or transfer rod 75 between abutting ends of piston stem 76 in the front of rifle 20 and bolt carrier key 65 towards the rear of the rifle. Movement rearwards of piston 72 during this initial piston actuation stage needs only slightly compress piston spring 94 and transfer rod spring 93 by a small amount sufficient to pre-tension transfer rod 75 since this partial piston displacement is not intended to fully cycle the action.

The operation of the gas piston linkage pre-tensioning system will now be described with primary reference to FIGS. 24-25, which are partial cross-sectional views of relevant portions of the gas piston system 70 and barrel assembly 30. FIG. 24 shows the gas piston system 70 in the first initial stage piston actuation position prior to any piston displacement and immediately after rifle 20 is discharged. Combustion gases G are flowing rapidly forward in barrel bore 34 following behind the bullet (not shown) traveling towards muzzle end 32 of barrel 31. Piston head 78 is positioned or located in piston bore 73 and thrust stud 130 is inserted into passageway 123 of pressure regulator 74. A portion of the gases G are bled off, enter, and fill axial passageway 123 of pressure regulator 74 to actuate the gas piston system 70. Piston bore 73 is essentially isolated from gases G at this point by piston 72 (i.e. front face 131) being abutted against pressure regulator 74 and the thrust stud 130 being inserted in passageway 123 which blocks the flow of gas to piston bore 73. In this initial first stage piston actuation, the combustion gases G are acting only upon end surface 133 of thrust stud 130 with associated surface area SA1, not on the entire piston face 131. An initial axial force SF1 is exerted on piston 72 in a rearward direction to drive and displace the piston partially rearwards. In a preferred embodiment, force SF1 is not sufficient to fully actuate the piston mechanism or cycle the action. Under force SF1, piston 72 is therefore axially displaced rearward by an initial first distance that is less than the full travel or stroke of the piston in piston bore 73. During the piston's initial partial travel rearward, stud 130 preferably remains at least partially inserted in passageway 123 for a length of time wherein full pressurization of piston bore 73 by combustion gases G does not occur. This provides sufficient time and force to bring piston 72 (i.e. stem 76), transfer rod 75, and bolt carrier key 65 into abutting, tightened relationship and remove any gaps therebetween prior to fully actuating the piston and pressurizing piston bore 73 for cycling the action. In one representative embodiment, the initial first distance during which time stud 130 remains in passageway 123 may be at least about 0.05 inches, which represents only a fraction of the full piston stroke which in some embodiments may be at least about 0.75 inches.

FIG. 25 shows gas piston system 70 in the second full stage piston actuation position during the rifle discharge sequence. Piston 72 has been displaced by a sufficient distance rearward such that thrust stud 130 has preferably been withdrawn from passageway 123 of pressure regulator 74 by an amount sufficient to allow combustion gases G to flow into and fill the full piston bore 73. Combustion gases G now exert pressure on the entire piston face 131 including end face 133 of thrust stud 130. Accordingly, gases G act on the total surface area SAT of piston face 131 which is larger than surface area SA1 of thrust stud alone 130. Gases G produces an axial force SF2 associated with total surface area SAT, which is preferably larger than force SF1. Force SF2 represents a full piston actuation force that displaces piston 72 in a rearward axial direction by a second distance (larger than the first initial distance under force SF1) along the remainder of its full length of travel or stroke with sufficient force to now drive bolt carrier 61 fully rearwards (via transfer of force SF2 through transfer rod 75 to the bolt carrier) to fully cycle the action. In one representative embodiment, the second distance may be at least about 0.70 inches in which a total piston stroke of at least about 0.75 inches may be used (with a first axial distance displacement of about at least 0.05 inches for pre-tensioning transfer rod 75). In cycling the action, bolt 64 (carried by bolt carrier 61) rotates and unlocks from barrel extension 100 to open the breech (i.e. bolt lugs 64 disengage bolt locking lugs 105). A spent cartridge casing is extracted from barrel chamber 111 and ejected from rifle 20 in a conventional manner as the bolt carrier 61 travels rewards to its rear-most position which full compresses main recoil spring (not shown). As piston head 78 passes external vent 201 in gas block 71, combustion gases G are vented to the outside of rifle 20 from piston bore 73 to relieve the pressure in the bore.

Bolt carrier 61 is next returned forward in a conventional manner by the main recoil spring (not shown) during which time a new cartridge is delivered from the magazine (not shown) and loaded into chamber 111 by bolt 64. Bolt 64 then re-engages and locks with barrel extension 100 to close the breech in preparation for firing the next round. Gas piston 72 returns forward under the biasing effect of at least piston spring 94. Thrust stud 130 re-enters passageway 123 of pressure regulator 74 and piston face 131 engages and is seated against the pressure regulator once again in the starting position shown in FIG. 24. The foregoing two stage piston actuation process is then ready to be repeated upon firing the next round.

In the usual operation of a gas piston system for a firearm, it will be understood by those skilled in the art that the full stroke and rearward displacement of piston 72 need not equal the full rearward travel of bolt carrier 61 to fully cycle the action. Acting through transfer rod 75, full piston actuation force SF2 causes an abrupt but powerful thrust by piston 72 against the transfer rod that sufficiently throws or pushes the rod rearward and bolt carrier therewith fully rearward after contact is broken between the piston and rod. The rearward piston travel is halted by piston head 78 abutting end wall 210 of piston bore 73 (shown in FIG. 7). Accordingly, in some embodiments bolt carrier 61 may have a full travel range (rearward and forward) during its cycle of about at least about 4-6 inches in some embodiments whereas the full stroke of piston 72 may only be about 0.75 inches. In addition, transfer rod 75 similarly need not necessarily travel fully rearward and remain in contact with bolt carrier 61 as the action is fully cycled.

It will be appreciated that the diameter of the thrust stud and piston, and the ratio between the two corresponding diameters can be varied as required to adjust the initial and final full thrust force exerted on the piston which is transferred to the transfer rod. Furthermore, the piston can be of a design disclosed herein or any other suitable conventional designs used for piston gas operated recoil system, including applicability to fixed gas tube type systems using a movable cylinder. Accordingly, a gas piston and system according to the present invention is not limited in its applicability to the gas operating system described herein and may be used in any suitable application where it is beneficial to vary the thrust force of a gas piston.

Barrel Latching Mechanism: Referring now to FIGS. 2 and 5-7, the quick-change barrel retaining system further includes a front barrel latching mechanism 140 for securing the barrel assembly 30 to handguard 50. This is intended to provide a secure connection between the forward portions of barrel assembly 130 and handguard 50 to stabilize the barrel, and prevents the barrel assembly from being unintentionally rotated which might disengage the barrel assembly from barrel nut 80 at the rear. In addition, the latching mechanism 140 provides additional rigidity between the barrel assembly 30 and handguard 50 when grenade launchers are mounted to and used with rifle 20. In a preferred embodiment, barrel latching mechanism is associated with handguard 50. In one embodiment, front barrel latching mechanism 140 includes spring-loaded latch plunger 141 which is disposed in latch plunger cavity 147 of handguard 50 for axial movement therein. Latch plunger 141 engages barrel assembly 30 for detachably locking the barrel assembly to handguard 50. Latch plunger 141 engages an aperture 145 in barrel assembly 30, which in a preferred embodiment may be formed in a latch flange 143. At least a portion of latch plunger 141 protrudes through and engages latch flange 143 to secure the barrel assembly 30 to handguard 50. The front end 146 of latch plunger 141 may be tapered and aperture 145 may have a complementary taper to assist in centering/guiding the latch plunger into the aperture and forming a secure frictional fit. In one embodiment, latch flange 143 may conveniently be formed as part of gas block 71 as shown. In other embodiments contemplated, latch flange may be a separate component from the gas block 71 and secured to or integral with barrel 31 independently of the gas block. Latch plunger 141 is preferably biased in a forward axial direction as shown by latch spring 142 which is disposed in latch plunger cavity 147. This keeps latch plunger 141 seated in the latch flange 143.

Barrel latching mechanism is movable from a latched position shown in FIG. 7 in which latch plunger 141 engages latch flange 143 to an unlatched position (not shown) in which plunger 141 is withdrawn from aperture 145 and flange 143.

To assist with drawing latch plunger 141 from aperture 145 in latch flange 141, a latch trigger 144 is provided which may engage or be integral with the latch plunger. In one embodiment, latch trigger 144 preferably extends in a lateral direction from latch plunger 141 transverse to the longitudinal axis LA of rifle 20, and more preferably may extend sideways from rifle 20 and handguard 50. However, other suitable arrangements are contemplated and may be used for latch trigger 144.

In one embodiment, barrel latching mechanism 140 may be disposed in handguard 50 on the bottom of the handguard opposite gas block 71. In other embodiments contemplated, barrel latching mechanism 140 may be disposed in other suitable positions such as on either side or the top of gas block 71. Accordingly, the invention is not limited to any particular position or configuration of barrel latching mechanism 140 so long as the barrel assembly 30 may be detachably engaged and locked to handguard 50.

Barrel Operating Handle: According to another aspect of the preferred embodiment, a movable barrel handle 150 is provided as shown in FIGS. 5, 6A-B, and 22 to facilitate rotating and removing barrel assembly 30 from rifle 20, including when the barrel assembly is hot. Barrel handle 150 provides lever so that the user can readily apply the required rotational force required to lock and unlock barrel assembly 30 from rifle 20. Using the barrel handle 150, barrel assembly 30 can further be replaced without the use of separate tools in a preferred embodiment.

Referring now to FIGS. 5, 6A-B, and 22, barrel handle 150 is preferably coupled to barrel assembly 30 and rotatable about longitudinal axis LA between a stowed position (shown in FIG. 22) in which the handle is tucked in proximate to barrel assembly 30 and a deployed position (shown in dashed lines in FIG. 22) in which the handle extends outwards farther from the barrel assembly than in the stowed position to provide a mechanical advantage to the user. Barrel handle 150 may be movably coupled to gas block 71 via a handle rod 151 which is received in a socket 152 disposed in the gas block. Handle rod 151 may be generally U-shaped in a preferred embodiment having barrel handle 150 disposed on one end of the rod and the other end of the rod being inserted into socket 152. Handle rod 151 may be forward biased by a spring 153 which is carried in socket 152 and acts on the rod. In a preferred embodiment, gas block 71 includes a configured guide notch 154 having an arcuate vertical portion 155 oriented transverse to the longitudinal axis LA and a horizontal straight top portion 156A and bottom portion 156B extending axially in opposite directions. Notch 154 communicates with socket 152. Handle rod 151 includes a transverse pin 157A in a preferred embodiment as shown that fits in hole 157B in handle rod 151 and travels in notch 154 for guiding and limiting movement of barrel handle 150.

Although embodiments according to principles of the present invention has been described for convenience with reference to a firearm in the form of a rifle, it will be appreciated that the invention may be used with any type of firearm or weapon wherein the invention may be utilized with similar benefit.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes and/or control logic as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A gas piston system for an autoloading firearm comprising:

a barrel having a longitudinally-extending bullet pathway;

a gas block defining a piston bore;

a reduced diameter axial passageway fluidly connecting the bore with the bullet pathway for diverting combustion gas from the pathway to the bore upon discharging the firearm, the fluid passageway being axially aligned with the piston bore and positioned forward of the bore, the passageway having a closed front end and a rear end which opens rearward into the piston bore; and a piston slidably disposed in the bore for reciprocating movement, the piston including a head having an axially-extending protrusion projecting towards the passageway, the protrusion being configured for slidable insertion into the passageway, the piston being movable from a first actuation position in which the protrusion is inserted into the passageway to a second actuation position in which the protrusion is at least partially withdrawn from the passageway;

wherein the protrusion blocks flow of combustion gas from the passageway to the piston bore when the piston is in the first position.

2. The gas piston system of claim 1, wherein the protrusion allows flow of combustion gas to the piston bore when the piston is in the second position.

3. The gas piston system of claim 1, wherein the protrusion is a cylindrical stud.

4. The gas piston system of claim 1, further comprising a spring disposed in the piston bore and biasing the piston in a forward direction towards the passageway.

5. The gas piston system of claim 1, further comprising a reciprocating bolt carrier slidably disposed in a receiver coupled to the barrel and a transfer rod operably linking the piston to the bolt carrier, the transfer rod being operative to transmit motion from the piston to the bolt carrier for automatically loading cartridges into the firearm.

6. The gas piston system of claim 5, further comprising a spring biasing the transfer rod towards the piston and a separate spring biasing the piston towards the passageway.

7. The gas piston system of claim 5, wherein the transfer rod is configured and arranged to abut a stem connected to the piston head and protruding rearwards through the gas block.

8. The gas piston system of claim 1, wherein the passageway is in fluid communication with a plurality of user selectable inlet orifices of varying sizes that fluidly connect the passageway to the bullet pathway for varying pressure of the combustion gas in the passageway.

9. The gas piston system of claim 8, wherein the passageway and inlet orifices are disposed in a rotatable pressure regulator supported by the gas block.

10. The gas piston system of claim 1, wherein the firearm is a rifle.

11. An autoloading firearm with gas piston operating system comprising:

a receiver slidably supporting a bolt carrier for reciprocating motion;

a barrel coupled to the receiver and having a longitudinally-extending bullet pathway;

a gas block defining a piston bore;

an axial passageway fluidly connecting the bore with the bullet pathway for diverting combustion gas having a pressure from the pathway to the bore produced by discharging the firearm, the fluid passageway being axially aligned with the piston bore and positioned forward of the bore, the passageway having a closed front end and a rear end which opens rearward into the piston bore;

a piston slidably disposed in the bore for reciprocating movement, the piston including a head defining a front face with a reduced diameter cylindrical stud projecting towards the passageway, the stud being slidably inserted in the passageway and the head being positioned in the bore;

a piston spring located in the bore and biasing the piston towards the passageway;

wherein the piston is movable in the bore by the combustion gas from:

(i) a forward axial position in which only an end face of the stud is initially exposed to the combustion gas pressure; to (ii) a rearward axial position in which the entire front face of the piston head including the end face of the stud are exposed to combustion gas pressure.

12. The gas piston system of claim 11, wherein the stud blocks flow of combustion gas from the passageway to the piston bore when the piston is in the first position.

13. The gas piston system of claim 11, wherein the stud allows flow of combustion gas to the piston bore when the piston is in the second position.

14. The gas piston system of claim 11, further comprising a transfer rod that operably links the piston to the bolt carrier for transferring motion of the piston to the bolt carrier for autoloading cartridges into the firearm.

15. A method for actuating a piston in an autoloading firearm having a gas operating system comprising:

providing a firearm having a barrel defining a chamber for holding a cartridge and a bullet pathway, a receiver attached to the barrel, a reciprocating bolt assembly slidably received in the receiver for reciprocating motion, a gas piston slidably disposed in a piston bore of a gas block attached to the barrel for cycling the bolt assembly between forward and rearward positions, the piston including a head with a reduced diameter axially-extending cylindrical protrusion projecting forwards from the head, the protrusion being configured for slidable insertion into a gas inlet axial passageway fluidly connected to the bullet pathway for operating the piston, the fluid passageway being axially aligned with the piston bore and positioned forward of the bore, the passageway having a closed front end and a rear end which opens rearward into the piston bore, and a mechanical linkage operably coupling the piston to the bolt assembly;

producing combustion gas having a pressure in the bullet pathway by discharging the firearm;

flowing a portion of the gas from the bullet pathway to the piston;

exerting a first gas pressure force on the piston;

displacing the piston by a first axial distance;

pre-tensioning the mechanical linkage between the gas piston and bolt assembly;

exerting a second gas pressure force on the piston larger than the first gas pressure force; and displacing the piston by a second axial distance sufficient to cycle the bolt between the forward and rearward positions.

16. The method of claim 15, further comprising a step of locating the head of the piston in the piston bore and the reduced diameter protrusion extending from the head into the passageway fluidly connecting the piston bore to the barrel prior to producing combustion gas.

17. The method of claim 15, wherein the first gas pressure force is created by the gas acting only on the cylindrical protrusion extending from a face of the piston, the protrusion having an end face with a diameter less than a diameter of the face of the piston.

18. A method for actuating a piston in an autoloading firearm having a gas operating system for cycling a reciprocating bolt assembly between forward and rearward positions for loading the firearm, the method comprising:

locating a piston having a head and a reduced diameter stud extending therefrom in a piston bore that slidably receives the piston, the piston being mechanically linked to the bolt assembly by a transfer rod;

blocking with the stud an axial passageway fluidly connecting a bullet pathway defined by a firearm barrel to the piston bore, the fluid passageway being axially aligned with the piston bore and positioned forward of the bore, the passageway having a closed front end and a rear end which opens rearward into the piston bore;

exposing a first surface area on the stud to combustion gas flowing through the passageway from discharging the firearm;

displacing the piston by a first axial distance;

exposing a second surface area on the piston larger than the first surface area of the stud to the combustion gas; and displacing the piston by a second axial distance larger than the first axial distance wherein the bolt assembly is driven rearward.

* * * * *